US010877432B2

(12) United States Patent
Saito et al.

(10) Patent No.: US 10,877,432 B2
(45) Date of Patent: Dec. 29, 2020

(54) POWDER CONTAINER, PROCESS CARTRIDGE, AND IMAGE FORMING APPARATUS

(71) Applicants: Osamu Saito, Kanagawa (JP); Hiroaki Nieda, Kanagawa (JP)

(72) Inventors: Osamu Saito, Kanagawa (JP); Hiroaki Nieda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/677,862

(22) Filed: Nov. 8, 2019

(65) Prior Publication Data

US 2020/0166886 A1 May 28, 2020

(30) Foreign Application Priority Data

Nov. 27, 2018 (JP) ..... 2018-221322

(51) Int. Cl.
*G03G 21/18* (2006.01)
*G03G 15/08* (2006.01)
(Continued)

(52) U.S. Cl.
CPC ..... *G03G 21/1825* (2013.01); *G03G 15/0868* (2013.01); *G03G 15/0886* (2013.01);
(Continued)

(58) Field of Classification Search
CPC ..... G03G 21/1825; G03G 21/12; G03G 15/0868; G03G 21/1647; G03G 15/0886;
(Continued)

(56) References Cited

U.S. PATENT DOCUMENTS 5,027,152 A * 6/1991 Oda ..... G03G 15/0896 399/111
RE34,344 E * 8/1993 Sakato ..... G03G 15/0896 399/119

(Continued)

FOREIGN PATENT DOCUMENTS

JP 4-250475 9/1992
JP 2005-242185 9/2005

(Continued)

OTHER PUBLICATIONS

Extended European Search Report dated Apr. 28, 2020 in corresponding European Patent Application No. 19211097.1, 11 pages (Continued)

*Primary Examiner* — Francis C Gray
(74) *Attorney, Agent, or Firm* — Oblon, McClelland, Maier & Neustadt, L.L.P.

(57) ABSTRACT

A powder container is detachably attached to an image forming apparatus or a removable component in the image forming apparatus. The powder container includes an operation device and a rotation portion to rotate with operation of the operation device. The rotation portion is configured to contact a wall of the image forming apparatus or the removable component in a state in which the rotation portion maintains a posture in a direction of attachment of the powder container to the image forming apparatus or the removable component and is rotatable together with an engagement portion, which is opposed to the wall, of the image forming apparatus or the removable component while engaging the engagement portion, without hindering the powder container from moving in the direction of attachment, to restrain the powder container from moving in a direction of detachment from the image forming apparatus or the removable component.

19 Claims, 20 Drawing Sheets

(51) Int. Cl.
*G03G 21/10* (2006.01)
*G03G 21/12* (2006.01)
*G03G 21/16* (2006.01)

(52) U.S. Cl.
CPC ..... *G03G 15/0889* (2013.01); *G03G 21/105* (2013.01); *G03G 21/12* (2013.01); *G03G 21/1647* (2013.01); *G03G 2215/067* (2013.01); *G03G 2215/0685* (2013.01); *G03G 2215/0802* (2013.01); *G03G 2221/1861* (2013.01)

(58) Field of Classification Search
CPC ..... G03G 21/105; G03G 15/0889; G03G 2215/0802; G03G 2215/067; G03G 2215/0685; G03G 2221/1861
See application file for complete search history.

(56) References Cited

U.S. PATENT DOCUMENTS 5,669,054 A * 9/1997 Uchida ..... G03G 15/167 399/121
9,360,797 B1 * 6/2016 Bayubay ..... G03G 15/0886
10,627,743 B2 * 4/2020 Nieda ..... G03G 21/1814
2005/0191089 A1 * 9/2005 Nishimura ..... G03G 21/1825 399/111
2015/0086242 A1 3/2015 Tsuchiya
2016/0109827 A1 * 4/2016 Yoshida ..... G03G 15/0886 399/260
2018/0253032 A1 9/2018 Yoshida et al.
2019/0243284 A1 * 8/2019 Nieda ..... G03G 21/1814
2019/0243285 A1 * 8/2019 Nieda ..... G03G 15/0889
2019/0286011 A1 * 9/2019 Nieda ..... G03G 21/1814

FOREIGN PATENT DOCUMENTS

JP 2015-031865 2/2015
JP 2019-159310 A 9/2019
WO WO 2018/062571 A1 4/2018

OTHER PUBLICATIONS

U.S. Appl. No. 16/390,263, filed Apr. 22, 2019, Hiroaki Nieda.

* cited by examiner

POWDER CONTAINER, PROCESS CARTRIDGE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-221322, filed on Nov. 27, 2018, in the Japan Patent Office, the entire disclosure of which is hereby incorporated by reference herein.

BACKGROUND

Technical Field

Embodiments of the present disclosure generally relate to a powder container to store powder therein, a process cartridge including the powder container, and an image forming apparatus.

Description of the Related Art

There is known an image forming apparatus, such as a copier, a printer, and a facsimile machine, that includes a toner container (powder container) that is detachably attachable to the image forming apparatus or to a removable component, such as a process cartridge, a developing device, and the like, to store toner (powder).

SUMMARY

Embodiments of the present disclosure describe an improved powder container configured to be detachably attached to one of an image forming apparatus and a removable component that is removably installed in the image forming apparatus. The powder container includes an operation device and a rotation portion configured to rotate in conjunction with operation of the operation device. The rotation portion is configured to contact a wall of the one of the image forming apparatus and the removable component in a state in which the rotation portion maintains a posture in a direction of attachment of the powder container to the one of the image forming apparatus and the removable component and is rotatable together with an engagement portion, which is opposed to the wall, of the one of the image forming apparatus and the removable component while engaging the engagement portion, without hindering the powder container from moving in the direction of attachment. This configuration restrains the powder container from moving in a direction of detachment of the powder container from the one of the image forming apparatus and the removable component.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
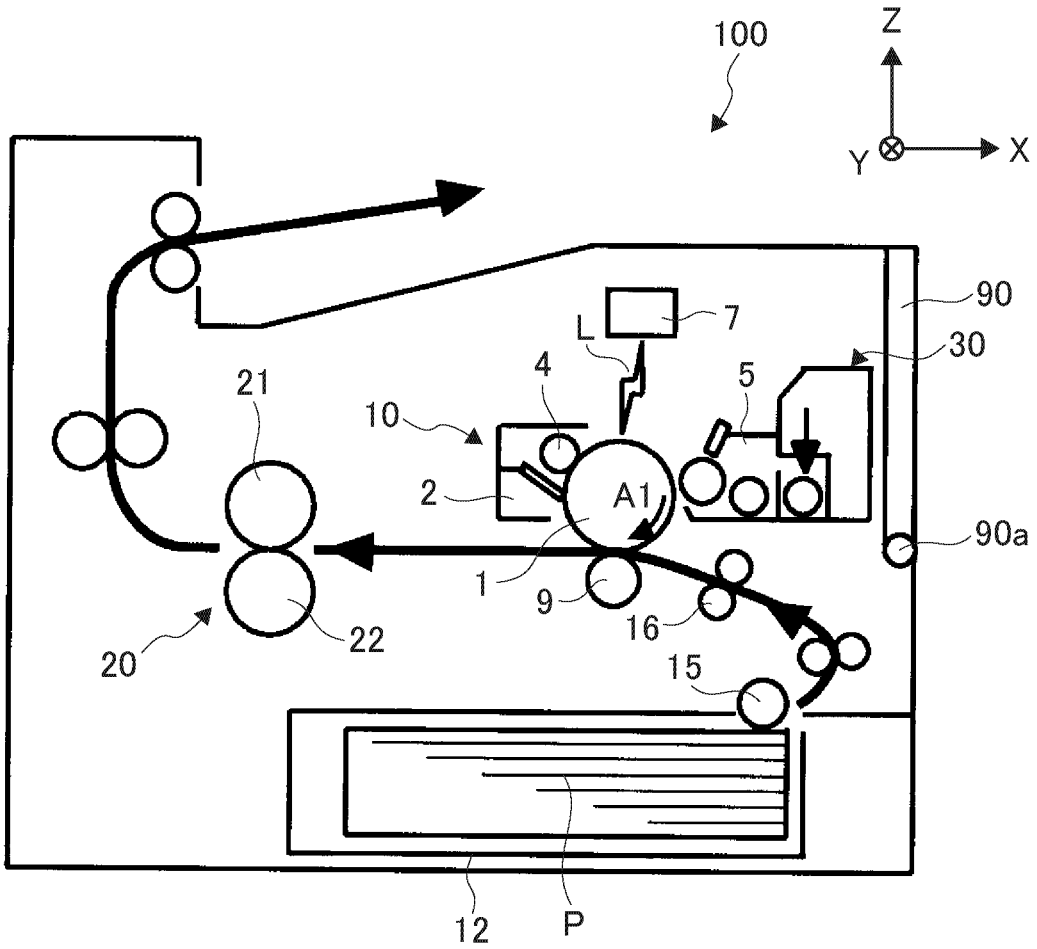
FIG. 1 is a schematic view illustrating a configuration of an image forming apparatus according to embodiments of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Embodiments of the present disclosure are described in detail with reference to drawings. It is to be understood that identical or similar reference numerals are assigned to identical or corresponding components throughout the drawings, and redundant descriptions are omitted or simplified below as required.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

With reference to FIG. 1, a configuration and operation of an image forming apparatus 100 is described below.

In FIG. 1, the image forming apparatus 100 that is a printer in the present embodiment includes a photoconductor drum 1 on which a toner image is formed, and an exposure device (writing device) 7 that irradiates the photoconductor drum 1 with exposure light L based on image data input from an input device such as a personal computer.

The image forming apparatus 100 further includes: a transfer roller 9 to transfer the toner image borne on a surface of the photoconductor drum 1 to a sheet P conveyed to a transfer nip (transfer position); a process cartridge 10 in which the photoconductor drum 1, a charging roller 4, a developing device 5, a cleaner 2, and an excess toner conveyor 6 (see FIG. 2) are united; and a sheet feeder (sheet tray) 12 to accommodate the sheets P such as paper sheets.

The image forming apparatus 100 yet further includes a registration roller pair (timing roller pair) 16 to feed the sheet P toward the transfer nip where the photoconductor drum 1 contacts the transfer roller 9, a fixing device 20 to fix an unfixed image on the sheet P, and a toner container 30 as a powder container. The fixing device 20 includes a fixing roller 21 and a pressure roller 22.

Around the photoconductor drum 1, the charging roller 4, the developing device 5, the cleaner 2, and the excess toner conveyor 6 are disposed. The above components (i.e., the photoconductor drum 1, the charging roller 4, the developing device 5, the cleaner 2, and the excess toner conveyor 6) are united as the process cartridge 10. The process cartridge 10 as a removable component is removably installed in the image forming apparatus 100. The process cartridge 10 is replaced with a new process cartridge in a certain replacement cycle.

Above the process cartridge 10 (or the developing device 5) as the removable component, the replaceable toner container 30 as the powder container is detachably attached to the image forming apparatus 100. A toner storage 31 (see FIG. 2) of the toner container 30 stores toner (fresh toner) as powder. The toner is appropriately supplied from the toner container 30 to the interior of the developing device 5. When the toner container 30 runs out of toner (or toner contained in the developing device 5 is depleted), the toner container 30 is replaced with a new toner container. Note that, the toner container 30 according to the present embodiment further includes an excess toner collection portion (powder collection portion) 32 (see FIG. 2) in addition to the toner storage (powder storage) 31. The excess toner collection portion 32 is described in detail later.

Figure 2:
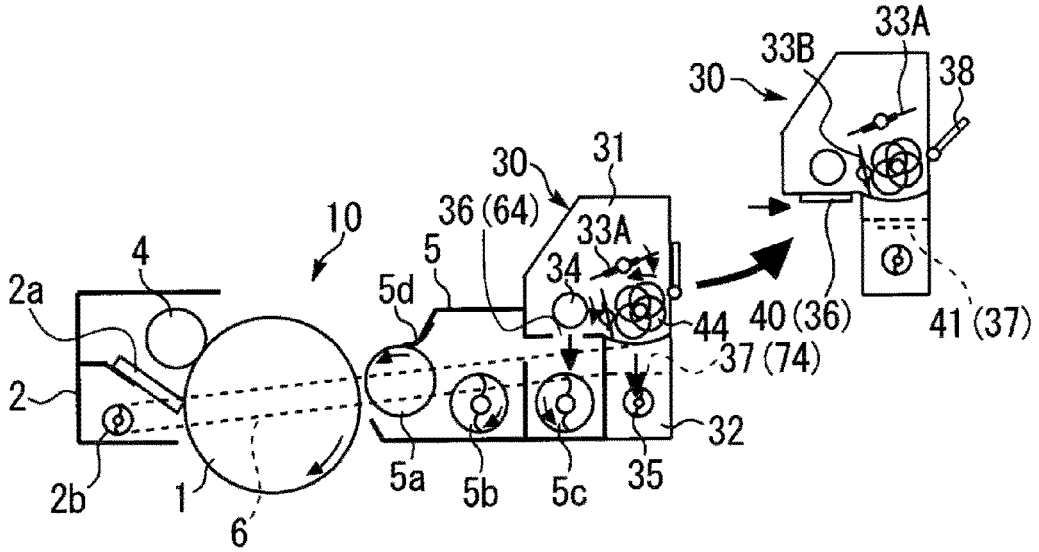
FIG. 2 is a schematic view of a process cartridge and a toner container according to embodiments of the present disclosure.

Now, a description is given of the image forming operations performed by the image forming apparatus 100 with reference to FIGS. 1 and 2.

With reference to FIG. 1, as image data is transmitted from the input device, such as a personal computer, to the exposure device 7 in the image forming apparatus 100, the exposure device 7 irradiates the surface of the photoconductor drum 1 with the exposure light (laser beam) L based on the image data.

Meanwhile, the photoconductor drum 1 rotates in a direction indicated by arrow A1 in FIG. 1, that is, a clockwise direction. A charging roller 4 uniformly charges the surface of the photoconductor drum 1 at a position opposite each other (charging process). As a result, a charging potential is formed on the surface of the photoconductor drum 1. In the present embodiment, the charging potential on the photoconductor drum 1 is approximately −900 V. The charged surface of the photoconductor drum 1 thereafter reaches an irradiation position of the exposure light L. An irradiated portion of the photoconductor drum 1 irradiated with the exposure light L has a latent image potential (about 0 to −100 V) and thus an electrostatic latent image is formed on the surface of the photoconductor drum 1 (exposure process).

The surface of the photoconductor drum 1 bearing the electrostatic latent image thereon then rotates until the surface of the photoconductor drum 1 reaches a position opposite the developing device 5. The developing device 5 deposits toner onto the photoconductor drum 1, and the latent image formed on the photoconductor drum 1 is thereby developed into the toner image (developing process).

As illustrated in FIG. 2, the developing device 5 includes a developing roller 5*a*, two conveying screws 5*b* and 5*c*, and a doctor blade 5*d*. The developing device 5 contains toner (one-component developer). Toner is supplied from a discharge port 36 of the toner container 30 (toner storage 31) to the developing device 5 via an inlet port 64 of the developing device 5 according to consumption of toner in the developing device 5. The two conveying screws 5*b* and 5*c* stir and mix the supplied toner with the toner contained in the developing device 5 while circulating the toner in a longitudinal direction of the developing device 5, that is, a direction perpendicular to the surface of the paper on which FIG. 2 is drawn. The developing roller 5*a* scoops up a part of the toner conveyed by the conveying screw 5*b*. The toner scooped up by the developing roller 5*a* is regulated by the doctor blade 5*d* and reaches a position (development range) opposite the photoconductor drum 1. At that time, the toner on the developing roller 5*a* is rubbed by the doctor blade 5*d* and triboelectrically charged. The toner adheres to the electrostatic latent image on the photoconductor drum 1 at the development range, thereby forming the toner image on the photoconductor drum 1. The developing roller 5*a* and the two conveying screws 5*b* and 5*c* are rotated in directions indicated by arrows in FIG. 2 by a drive motor included in the image forming apparatus 100, respectively.

After the developing process, the surface of the photoconductor drum 1 bearing the toner image thereon reaches the transfer nip (transfer position) between the photoconductor drum 1 and the transfer roller 9. In the transfer nip between the photoconductor drum 1 and the transfer roller 9, a transfer bias, which has a polarity opposite that of the toner, is supplied from a power source to the transfer roller 9, and the toner image formed on the photoconductor drum 1 is thereby transferred onto the sheet P fed by the registration roller pair 16 (transfer process).

The surface of the photoconductor drum 1 after the transfer process continues to rotate until the surface of the photoconductor drum 1 reaches a position opposite the cleaner 2. At this position, untransferred toner remaining on the surface of the photoconductor drum 1 is mechanically removed by a cleaning blade 2*a* and collected in the cleaner 2 (cleaning process) to complete a series of image forming processes on the photoconductor drum 1.

A collection screw 2*b* of the cleaner 2 conveys the untransferred toner collected in the cleaner 2 to one end of the cleaner 2 in a width direction (direction of rotation axis) of the collection screw 2*b*. The excess toner conveyor 6 including an excess toner coil 6*a* (see FIG. 6B) conveys the untransferred toner in a diagonally upper right direction in FIG. 2. Thus, the untransferred toner is collected in the excess toner collection portion 32 of the toner container 30 as excess toner (waste toner) from an outlet port 74 of the excess toner conveyor 6 via a collection port 37 of the toner container 30.

In the new toner container 30, the toner storage 31 is filled with fresh toner, and the excess toner collection portion 32 is empty.

The sheet P is conveyed to the transfer nip (transfer position) between the photoconductor drum 1 and the transfer roller 9 as follows.

First, a feed roller 15 feeds the topmost sheet P of the stack of sheets P accommodated in the sheet feeder 12 toward a conveyance path.

Thereafter, the sheet P reaches the registration roller pair 16. The sheet P that has reached the registration roller pair 16 is fed to the transfer nip (i.e., the contact position of the transfer roller 9 with the photoconductor drum 1) in synchronization with an entry of the toner image formed on the photoconductor drum 1 into the transfer nip.

After the transfer process, the sheet P passes through the transfer nip (i.e., the position of the transfer roller 9) and reaches the fixing device 20 through the conveyance path. In the fixing device 20, the sheet P is interposed between the fixing roller 21 and the pressure roller 22. The toner image is fixed on the sheet P by heat applied from the fixing roller 21 and pressure applied from both of the fixing roller 21 and the pressure roller 22. The sheet P having the fixed toner image thereon is discharged from the fixing nip between the fixing roller 21 and the pressure roller 22, ejected from the image forming apparatus 100, and stacked on an output tray to complete the image forming process.

Figure 3A:
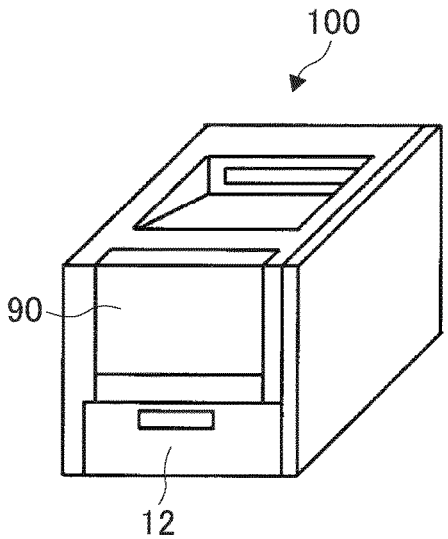
FIG. 3A is a perspective view of the image forming apparatus with a cover closed according to embodiments of the present disclosure.
Figure 3B:
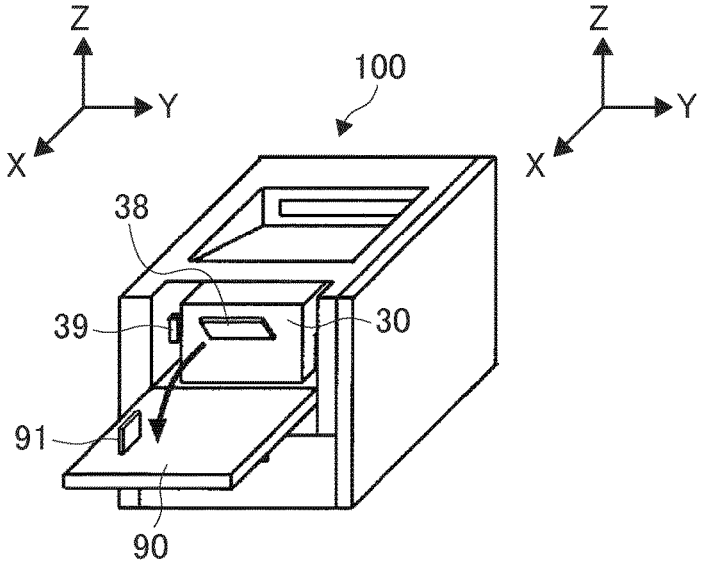
FIG. 3B is a perspective view of the image forming apparatus with the cover open according to embodiments of the present disclosure.

The image forming apparatus 100 has a plurality of exterior covers as illustrated in FIG. 3A. As illustrated in FIG. 3B, a part of a front exterior cover functions as a cover 90 that is rotatably opened and closed.

More specifically, the cover 90 is secured to the image forming apparatus 100 and hinged around a spindle (a rotation shaft) 90*a* as illustrated in FIG. 1. As the cover 90 rotates counterclockwise in FIG. 1 around the spindle 90*a*, the cover 90 closes as illustrated in FIGS. 1 and 3A. As the cover 90 rotates clockwise in FIG. 1 around the spindle 90*a*, the cover 90 opens as illustrated in FIG. 3B.

In the present embodiment, as illustrated in FIG. 3B, the toner container (powder container) 30 is exposed to be removably installable in the image forming apparatus 100 when the cover 90 is opened. By opening the cover 90, the toner container 30 alone (illustrated in FIG. 7) can be replaced with a new toner container, or the toner container 30 together with the process cartridge 10 can be replaced with a new one (the process cartridge 10 and the toner container 30 illustrated in FIG. 4).

Image forming processes (printing operations) described above with reference to FIG. 1 are performed when the cover 90 is closed as illustrated in FIG. 1.

The configuration and operation of the toner container (powder container) 30 according to the present embodiment are described in further detail below.

In the present embodiment, as illustrated in FIG. 2, the toner container 30 as the powder container is detachably attachable to the process cartridge 10. In particular, in the present embodiment, the toner container 30 is detachably attachable to the process cartridge 10 both while the process cartridge 10 is installed in the image forming apparatus 100 and while the process cartridge 10 is removed from the image forming apparatus 100.

As described above with reference to FIG. 3B, the toner container 30 is detachably attachable to the process cartridge 10 installed in the image forming apparatus 100. In other words, the toner container 30 as the powder container is indirectly installable in and removable from the image forming apparatus 100.

In the present embodiment, the toner container 30 is indirectly installable in and removable from the image forming apparatus 100. Alternatively, the toner container 30 is directly installable in and removable from the image forming apparatus 100.

The process cartridge 10 is the removable component that is removably installable in the image forming apparatus 100. In addition to the process cartridge 10, the developing device 5 and other devices can function as the removable components. The toner container (powder container) 30 can be detachably attachable to a removable component other than the process cartridge 10.

Figure 4:
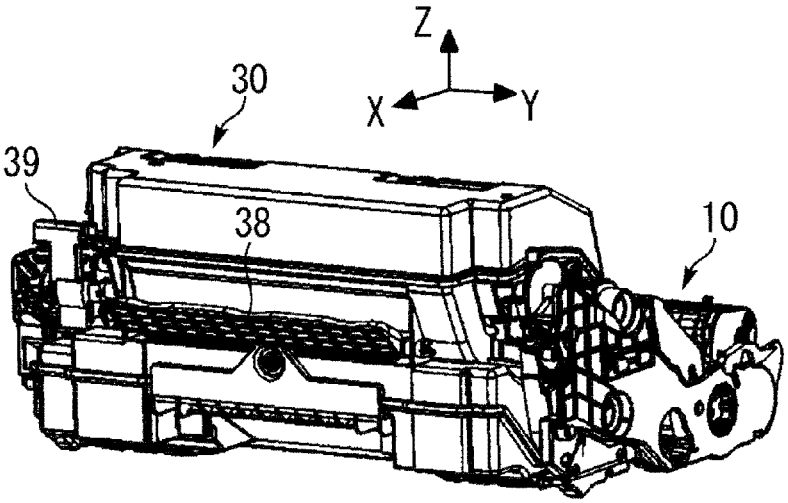
FIG. 4 is a perspective view of the process cartridge to which the toner container is attached.
Figure 5:
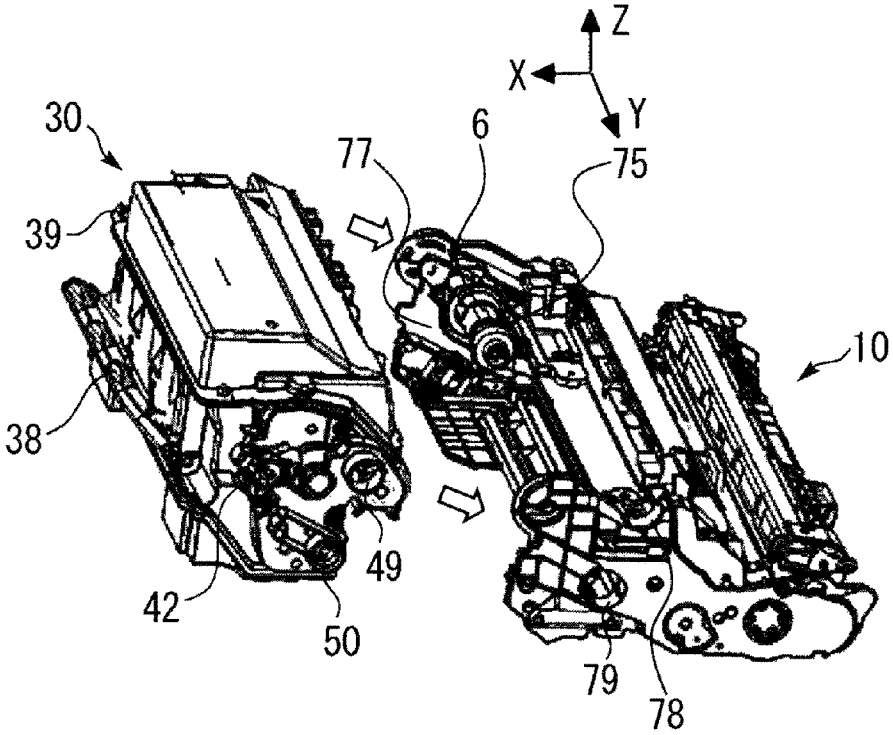
FIG. 5 is a perspective view of the process cartridge from which the toner container is detached.
Figure 6A:
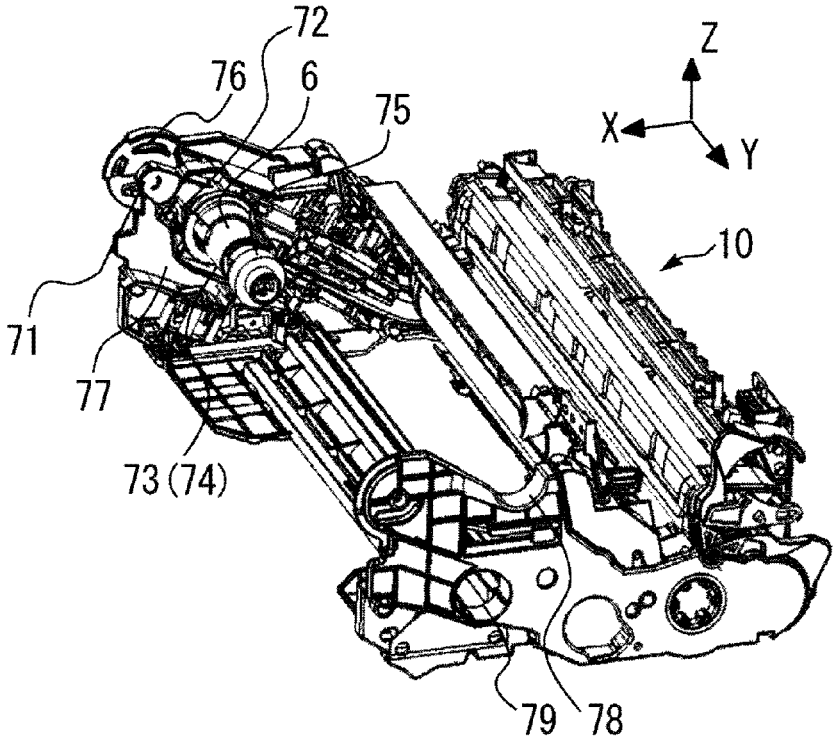
FIGS. 6A and 6B are perspective views of the process cartridge.
Figure 6B:
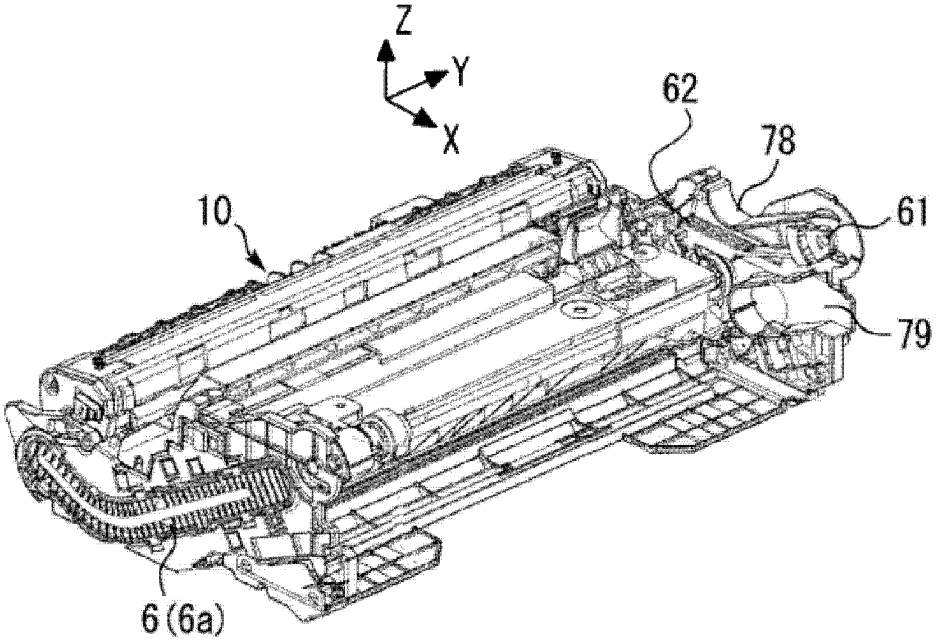
Figure 7:
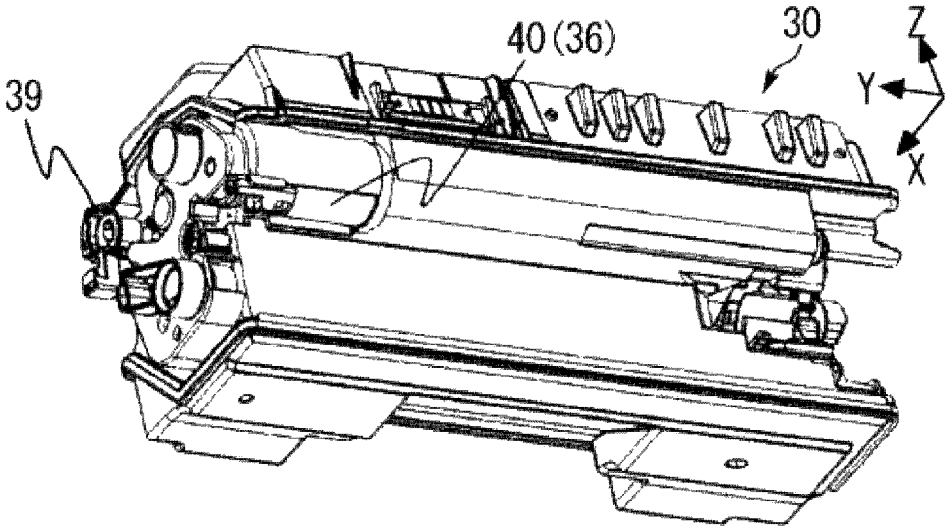
FIG. 7 is a perspective view of the toner container with a first container shutter (and a discharge port) closed when viewed from below.

Furthermore, as illustrated in FIG. 4, a single removable component (a united component formed of the toner container 30 and the process cartridge 10) in which the toner container 30 is attached to the process cartridge 10 is removably installable in the image forming apparatus 100. As illustrated in FIG. 5, the toner container 30 can be attached to the process cartridge 10, moving in a predetermined direction indicated by blank arrows in FIG. 5. On the other hand, the toner container 30 can be removed from the process cartridge 10, moving in a direction opposite to the predetermined direction. The toner container 30 alone as illustrated in FIG. 7 is distributed in the market. The process cartridge 10 alone as illustrated in FIGS. 6A and 6B is similarly distributed in the market.

When the toner container 30 is attached to or detached from the process cartridge 10 (or the image forming apparatus 100), an operator, such as a user, pulls out or pushes in the toner container 30, while gripping a handle 38 of the toner container 30. The handle 38 is attached to the front side of the toner container 30 in a direction of detachment operation (positive X-direction) as illustrated FIGS. 2 to 5. The handle 38 is foldable. When the cover 90 closes in a state in which the toner container 30 is installed in the image forming apparatus 100 with the handle 38 standing up as illustrated in FIGS. 4 and 5, the handle 38 is pushed by the cover 90 in conjunction with movement of the cover 90 from an open state to a closed state, thereby accommodating the handle 38 along an exterior of the toner container 30.

Figure 8:
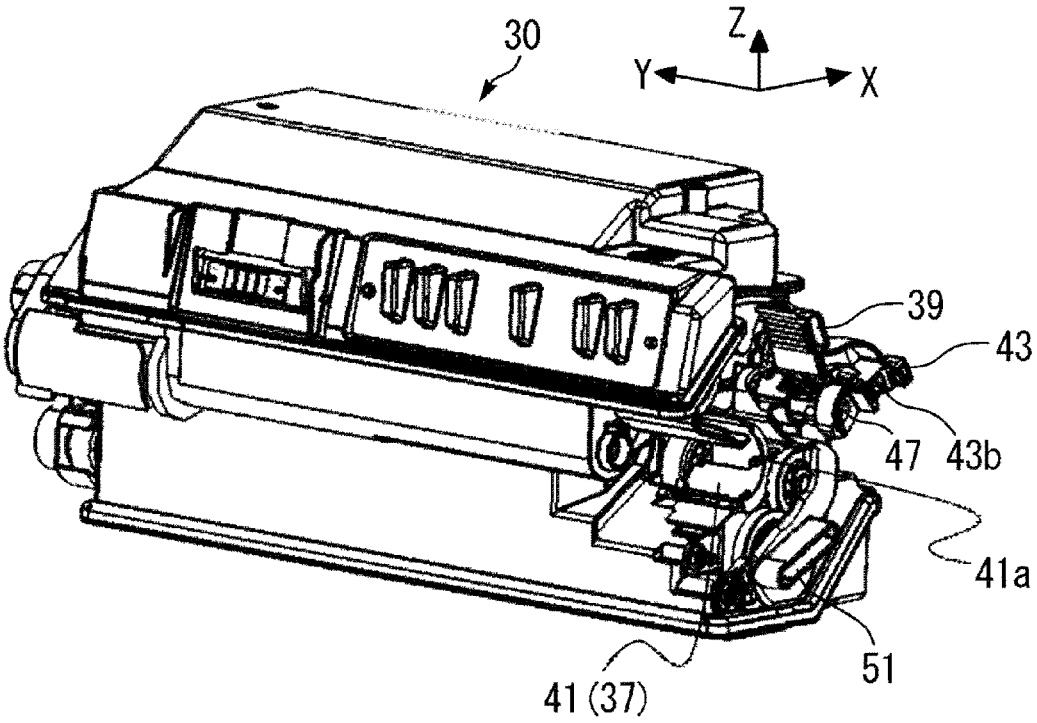
FIG. 8 is a perspective view of the toner container with a second container shutter (and a collection port) closed when viewed from the collection port side.

As illustrated in FIG. 5, the process cartridge 10 has multiple guide grooves 77 and 79, and a guide receiver 78, and the toner container 30 includes first and second positioning portions 49 and 50 and a guide 51 (see FIG. 8). The first and second positioning portions 49 and 50 and a guide 51 engage the guide receiver 78 and the multiple guide grooves 79 and 77, respectively. Thus, the toner container 30 can be detachably attached to the process cartridge 10 and positioned in the process cartridge 10.

Specifically, the first and second positioning portions (positioning projections) 49 and 50 project from one end face of the toner container 30 in the width direction of the toner container 30 (positive Y-direction). The guide receiver 78 and the guide groove 79 are disposed on one end face of the process cartridge 10 corresponding the one end face of the toner container 30. The guide 51 projects from the other end face of the toner container 30 (negative Y-direction) and has a rectangular shape which is inclined upward in positive X-direction. The guide receiver 78 introduces the first positioning portion 49, the guide groove 79 introduces the second positioning portion 50, and the guide groove 77 disposed at the other end face of the process cartridge 10 introduces the guide 51. Thus, the toner container 30 is attached to the process cartridge 10. The toner container 30 is positioned in the process cartridge 10 so that the first and second positioning portions 49 and 50 engage dead ends of the guide receiver 78 and the guide groove 79, respectively, and the guide 51 engages a dead end of the guide groove 77.

The first positioning portion 49 is a projection surrounding a coupling that transmits driving force from the image forming apparatus 100 to a first stirrer 33A (see FIGS. 2 and 9) to stir toner. The driving force input to the first stirrer 33A is input to a second stirrer 33B via a gear train, and the first and second stirrers 33A and 33B rotate clockwise in FIG. 9.

Figure 9:
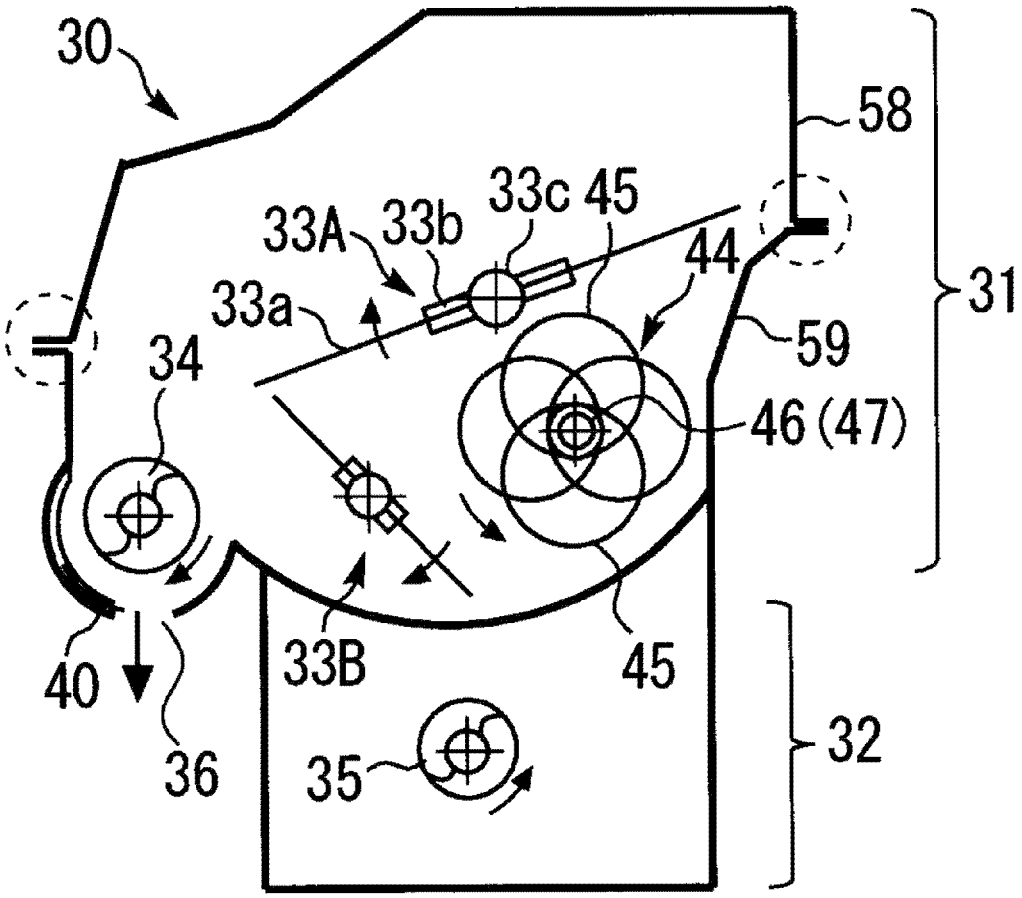
FIG. 9 is a schematic view of an interior of the toner container.

The second positioning portion 50 is a projection surrounding a coupling gear to rotate an excess toner conveying screw 35 (see FIGS. 2 and 9). As described above, input portions to receive the driving force from the image forming apparatus 100 are disposed near (inside) the first and second positioning portions 49 and 50, enabling reliable driving force transmission.

The toner container (powder container) 30 includes the discharge port 36, the collection port 37, a first container shutter 40, and a second container shutter 41.

With reference to FIGS. 2, 7, and 9, it can be seen that the discharge port 36 of the toner container 30 is an opening to discharge toner (powder) stored in the toner container 30 (toner storage 31) to the developing device 5. The discharge port 36 communicates with the inlet port 64 of the developing device 5 when the toner container 30 is attached to the process cartridge 10. The inlet port 64 is an opening disposed above the conveying screw 5*c*.

Figure 10:
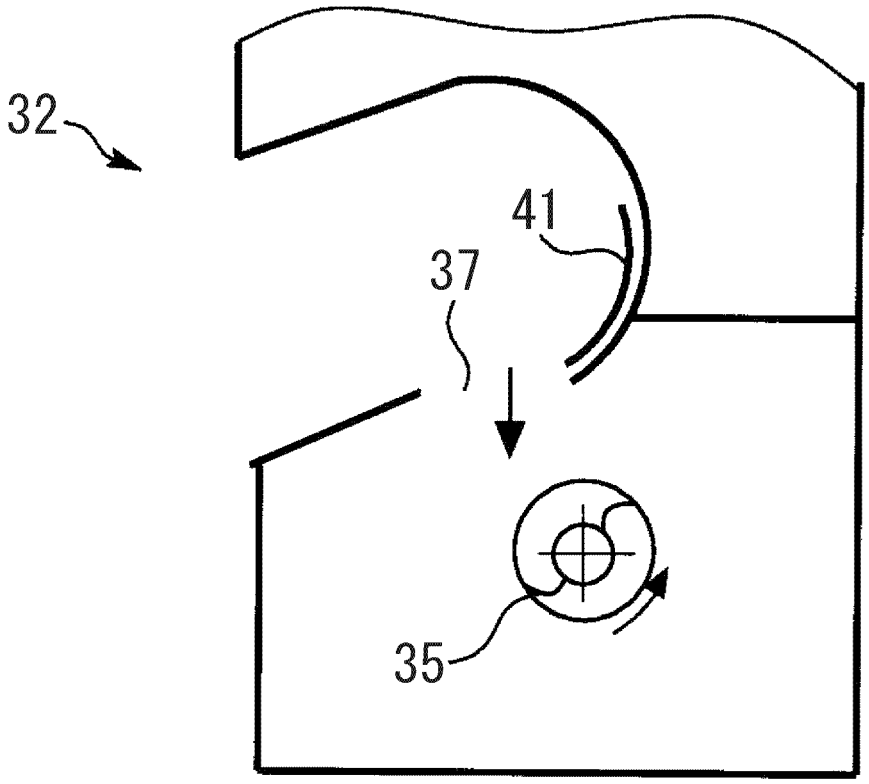
FIG. 10 is a schematic view of an excess toner collection portion of the toner container.

With reference to FIGS. 2, 8, and 10, the collection port 37 of the toner container 30 is an opening to receive excess toner (untransferred toner) as powder from the outside of the toner container 30 and to collect the excess toner in the toner container 30. The collection port 37 communicates with the outlet port 74 of the excess toner conveyor 6 when the toner container 30 is attached to the process cartridge 10. The outlet port 74 (see FIGS. 5 and 6) is an opening disposed on a bottom face of a downstream end of the excess toner conveyor 6 in a direction of conveyance of the excess toner.

In the toner container 30 according to the present embodiment, with reference to FIGS. 2, 9, and 10, the toner storage 31, as the powder storage, to store toner (powder) to be discharged from the discharge port 36 is separated from the excess toner collection portion 32 serving as the powder collection portion to collect the excess toner (powder) received from the collection port 37, by a partition.

The toner storage (powder storage) 31 further includes a supply screw 34 as a conveyor to rotate clockwise in FIGS. 2 and 9, the first and second stirrers (first and second agitators) 33A and 33B to rotate clockwise in FIGS. 2 and 9, and a coil-shaped stirrer 44. The coil-shaped stirrer 44 is rotated counterclockwise in FIGS. 2 and 9 by contact with the first stirrer 33A.

The supply screw 34 as the conveyor discharges a target amount of toner stored in the toner storage 31 from the discharge port 36 according to a drive timing and rotation duration controlled by a controller. In particular, in the present embodiment, the supply screw 34 functions as the conveyor that conveys toner stored in the toner storage 31 (toner container 30) in a predetermined direction of conveyance along an axis of rotation of the supply screw 34 toward the discharge port 36 disposed at the end portion of the toner storage 31 in the Y-direction.

The first stirrer (first agitator) 33A rotates around a rotation shaft 33*c* in a predetermined direction (clockwise direction in FIGS. 2 and 9 in the present embodiment) to stir toner stored in the toner storage 31 to prevent toner from aggregating. As illustrated in FIG. 9, the first stirrer 33A includes a flexible member 33*a*, a rigid body 33*b*, and the rotation shaft 33*c*. The flexible member 33*a* is made of a plastic sheet and rotates around the rotation shaft 33*c*. The rigid body 33*b* is plate-shaped and disposed across the rotation shaft 33*c* to nip and hold the flexible member 33*a*. The second stirrer 33B has a configuration similar to the first stirrer 33A and rotates in a predetermined direction (clockwise direction in FIGS. 2 and 9 in the present embodiment) to stir toner stored in the toner storage 31 to prevent toner from aggregating. Both ends of the first and second stirrers 33A and 33B in the direction of axes thereof are rotatably supported by the housing of the toner container 30 via pairs of bearings, respectively.

The coil-shaped stirrer 44 stirs toner in a region of the toner storage 31 where the first stirrer 33A does not sufficiently stir. The coil-shaped stirrer 44 includes a coil 45 including a plurality of divided coil portions 45*a* to 45*d* and a hollow member 46 to hold the coil 45. A piercing shaft 47 as a shaft is inserted into the hollow member 46. The piercing shaft 47 is one of the components included in a mechanism to open and close the first container shutter 40 and the second container shutter 41 in conjunction with each other. The configuration of the above components is described in detail later with reference to FIGS. 16 to 18.

In the excess toner collection portion (powder collection portion) 32, the excess toner conveying screw 35 to rotate counterclockwise in FIG. 2 is disposed. The excess toner conveying screw 35 conveys excess toner so that the excess toner that flows through the collection port 37 does not accumulate near (under) the collection port 37 and is evenly collected (distributed) in the excess toner collection portion 32.

In the present embodiment, as an operator pivots a lever 39 in a state in which the toner container 30 is attached to the process cartridge 10 (or the image forming apparatus 100), the first container shutter 40 (discharge port 36) and the second container shutter 41 (collection port 37) simultaneously open and close. In addition to the first and second container shutters 40 and 41, the inlet port 64 and the outlet port 74 of the process cartridge 10 also simultaneously open and close. Therefore, open and close failures of the first and second container shutters 40 and 41 and first and second cartridge shutters 63 and 73 are prevented.

When the cover 90 opens in a state in which the toner container 30 is installed in the image forming apparatus 100, the lever 39 is exposed as illustrated in FIG. 3B so that the operator can operate the lever 39.

Figure 11A:
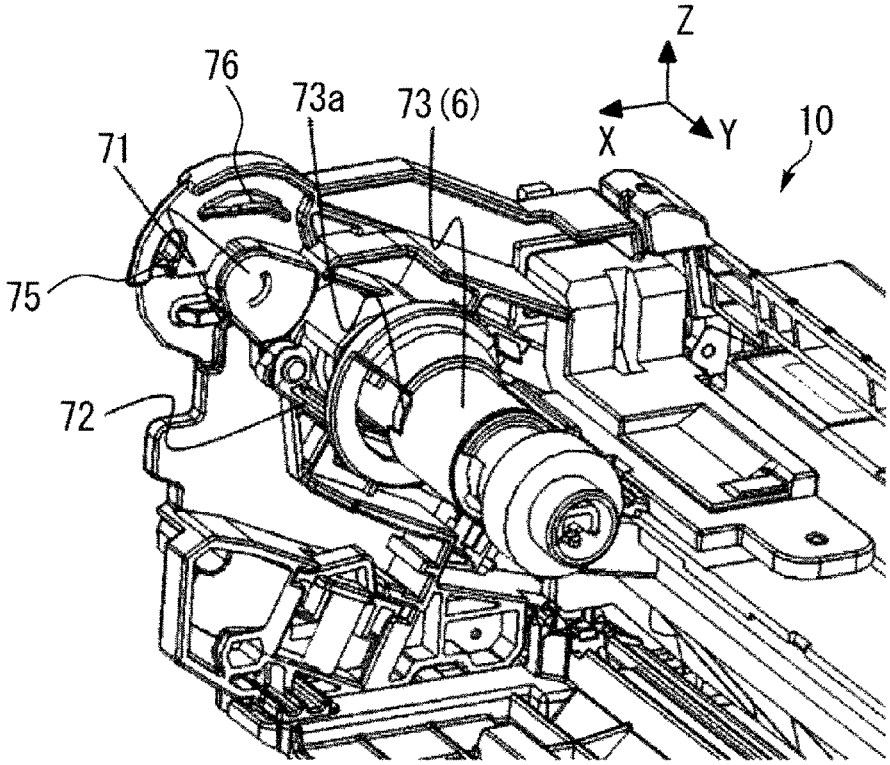
FIG. 11A is an enlarged perspective view illustrating a second engagement portion of the process cartridge and the surrounding structure.
Figure 11B:
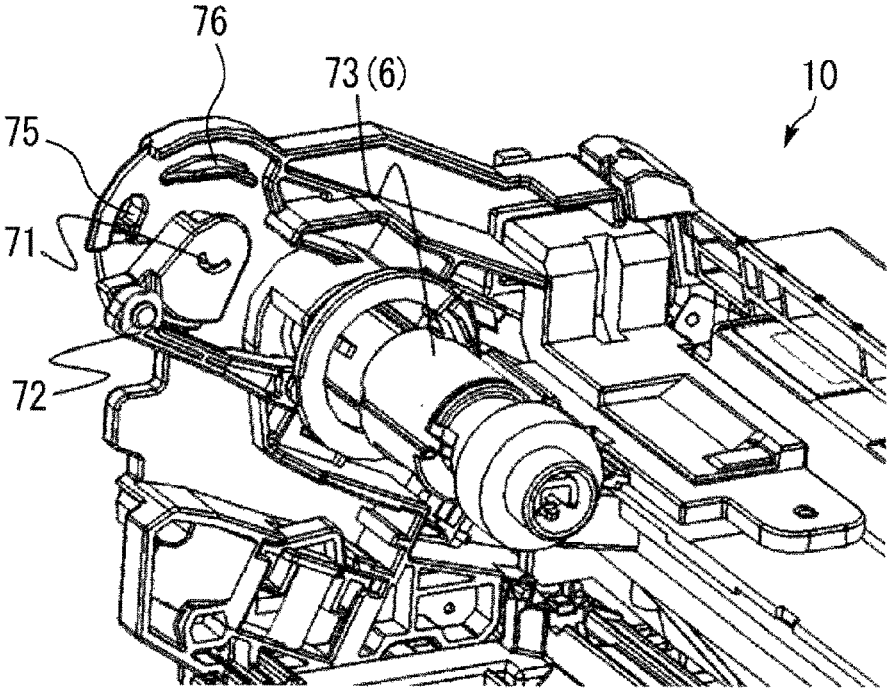
FIG. 11B is an enlarged perspective view illustrating a completed state of attachment of the second engagement portion engaged and rotated together with a second rotation portion of the toner container.
Figure 12A:
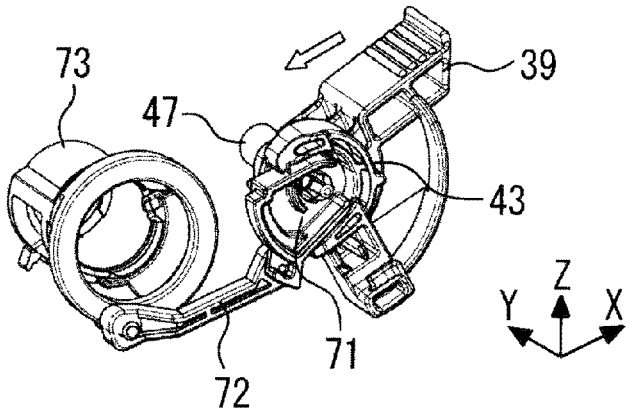
FIGS. 12A and 12B are perspective views illustrating a movement of a second cartridge shutter to open and close in the process cartridge.
Figure 12B:
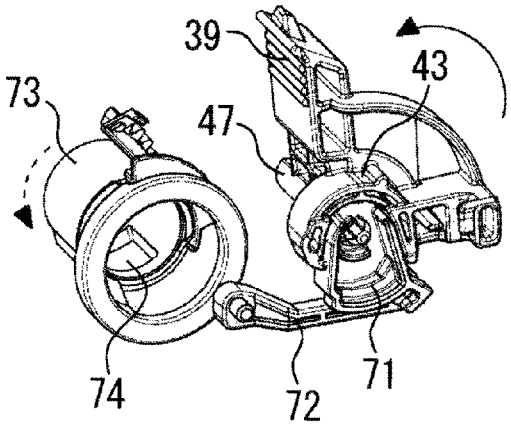

Specifically, as illustrated in FIGS. 8 and 12, the toner container 30 further includes the lever 39 and a second rotation portion 43. The second rotation portion 43 is formed together with the lever 39 as a single unit to rotate along with the lever 39. The second rotation portion 43 is engageable with a second engagement portion 71 (see FIGS. 11A to 12B). The second engagement portion 71 has a substantially arc shape and is included in the process cartridge 10. Specifically, the second rotation portion 43 is shaped so that an arc-shaped portion is missing from a circle. In other words, the second rotation portion 43 is substantially C-shaped so as to match the shape of a projecting end, which is substantially arc-shaped, of the second engagement portion 71.

As illustrated in FIG. 12A, when the toner container 30 is attached to the process cartridge 10, the second engagement portion 71 of the process cartridge 10 is inserted into and engaged with the second rotation portion 43 of the toner container 30. As illustrated in FIG. 12B, as the lever 39 rotates in the direction indicated by the arrow in FIG. 12B in a state in which the second engagement portion 71 of the process cartridge 10 engages the second rotation portion 43 of the toner container 30, the second rotation portion 43 of the toner container 30 rotates together with the second engagement portion 71, thereby completing an engagement of the process cartridge 10 and the toner container 30. Accordingly, the toner container 30 does not move in a direction of being pulled out from the process cartridge 10.

As the second rotation portion 43 is rotated together with the second engagement portion 71 by the operation of the lever 39 from a state in FIG. 12A (and FIG. 13) to a state in FIG. 12B, a second link 72 coupled to the second engagement portion 71 of the process cartridge 10 moves in conjunction with the second engagement portion 71 in a direction to open the second cartridge shutter 73 of the process cartridge 10, thereby opening the outlet port 74. FIGS. 11A and 11B are schematic views illustrating operations on the process cartridge 10 side at that time.

Further, the second cartridge shutter 73 that moves in the direction to open the second cartridge shutter 73 pushes and moves the second container shutter 41 in a direction to open the second container shutter 41 of the toner container 30, thereby opening the collection port 37. As a result, the outlet port 74 of the process cartridge 10 communicates with the collection port 37 of the toner container 30. Thus, excess toner is delivered from the process cartridge 10 to the toner container 30 (excess toner collection portion 32).

When the toner container 30 is detached from the process cartridge 10, the second rotation portion 43 rotates in a reverse direction opposite to the above-described direction along with a reverse rotation of the lever 39, and the second link 72 moves in conjunction with the second rotation portion 43, thereby closing the second cartridge shutter 73 (outlet port 74) and the second container shutter 41 (collection port 37). As a result, the second rotation portion 43 of the toner container 30 disengages from the second engagement portion 71 of the process cartridge 10.

As illustrated in FIGS. 5, 15A, 15B, and 16, the toner container 30 further includes a first rotation portion 42 disposed opposite the lever 39 (and the second rotation portion 43) in the width direction of the toner container 30. The first rotation portion 42 is coupled to the second rotation portion 43 via the piercing shaft 47 as the shaft and rotates along with the lever 39 (, the second rotation portion 43, and the piercing shaft 47). The first rotation portion 42 is engageable with a first engagement portion 61 (see FIGS. 14, 15A, and 15B). The first engagement portion 61 has a substantially arc shape and is included in the process cartridge 10. Specifically, the first rotation portion 42 is shaped so that an arc-shaped portion is missing from a circle. In other words, the first rotation portion 42 is substantially C-shaped so as to match the shape of a projecting end, which is substantially arc-shaped, of the first engagement portion 61.

Figure 15A:
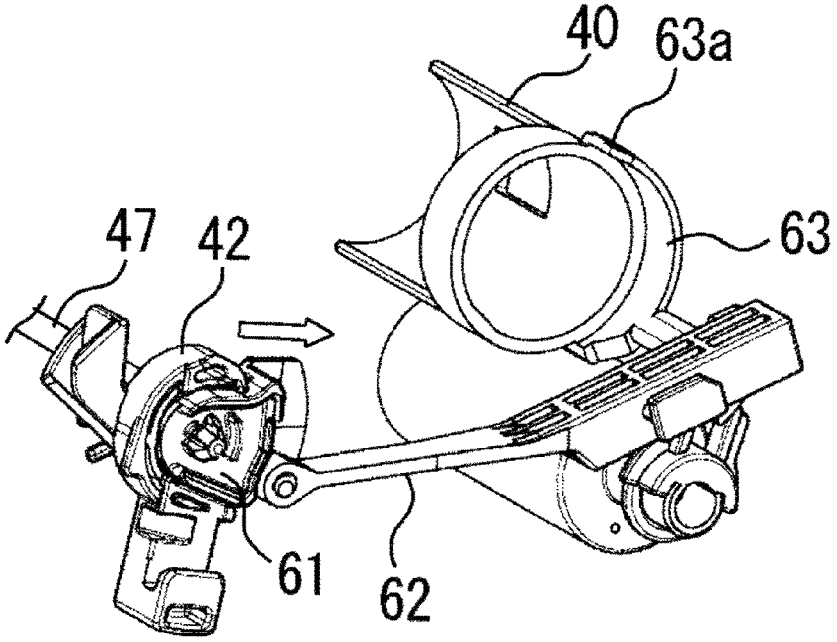
FIGS. 15A and 15B are perspective views illustrating a movement of a first cartridge shutter to open and close in the process cartridge.
Figure 15B:
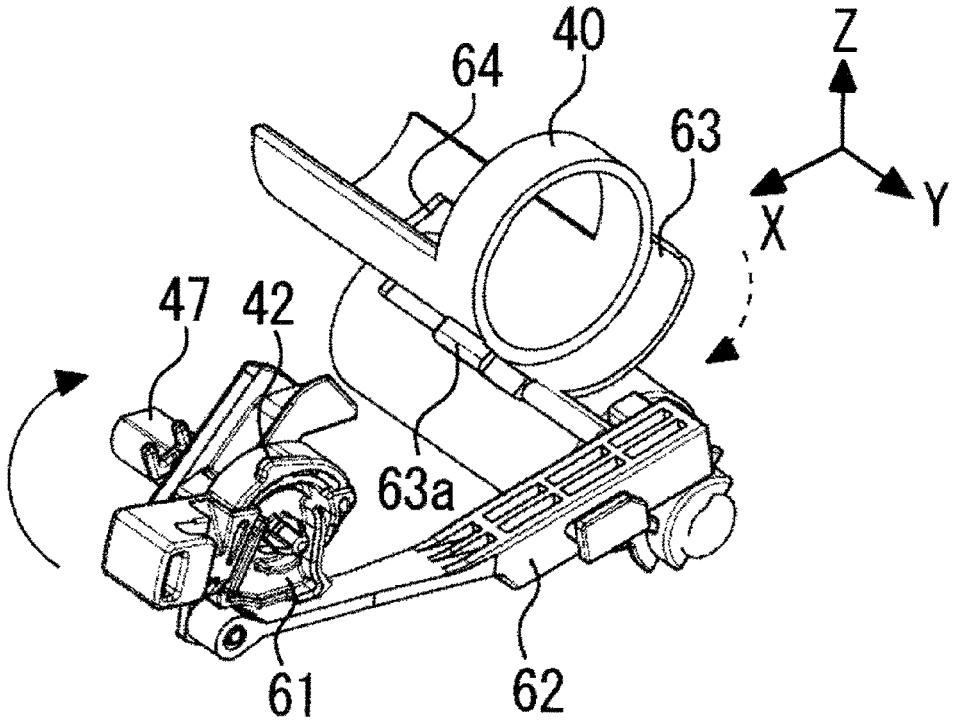

As illustrated in FIG. 15A, when the toner container 30 is attached to the process cartridge 10, the first engagement portion 61 of the process cartridge 10 is inserted into and engaged with the first rotation portion 42 of the toner container 30. As illustrated in FIG. 15B, as the lever 39 rotates in a state in which the first engagement portion 61 of the process cartridge 10 engages the first rotation portion 42 of the toner container 30, the first rotation portion 42 of the toner container 30 rotates together with the first engagement portion 61 via the piercing shaft 47, thereby completing the engagement of the process cartridge 10 and the toner container 30. Accordingly, the toner container 30 does not move in the direction of being pulled out from the process cartridge 10.

As the first rotation portion 42 is rotated together with the first engagement portion 61 by the operation of the lever 39 from a state in FIG. 15A to a state in FIG. 15B, a first link 62 coupled to the first engagement portion 61 of the process cartridge 10 moves in conjunction with the first engagement portion 61 in a direction to open the first cartridge shutter 63 of the process cartridge 10, thereby opening the inlet port 64. Further, a pushing portion 63*a* of the first cartridge shutter 63 that moves in the direction to open the first cartridge shutter 63 pushes the first container shutter 40 in a direction to open the first container shutter 40 of the toner container 30, thereby opening the discharge port 36. As a result, the inlet port 64 of the process cartridge 10 communicates with the discharge port 36 of the toner container 30 and fresh toner is delivered from the toner container 30 (toner storage 31) to the process cartridge 10 (developing device 5).

When the toner container 30 is detached from the process cartridge 10, the first rotation portion 42 rotates in the reverse direction opposite to the above-described direction along with the reverse rotation of the lever 39, and the first link 62 moves in conjunction with the first rotation portion 42, thereby closing the first cartridge shutter 63 (inlet port 64) and the first container shutter 40 (discharge port 36). As a result, the first rotation portion 42 of the toner container 30 disengages from the first engagement portion 61 of the process cartridge 10.

If the toner container 30 is installed in the image forming apparatus 100 in a state in which the lever 39 falls as illustrated in FIG. 5, the lever 39 is pushed by a pushing member 91 (see FIG. 3B) of the cover 90 in conjunction with movement of the cover 90 from the open state to the closed state, simultaneously causing the first container shutter 40 to open the discharge port 36, the first cartridge shutter 63 to open the inlet port 64, the second container shutter 41 to open the collection port 37, and the second cartridge shutter 73 to open the outlet port 74. Therefore, a set failure of the toner container 30 can be prevented.

The pushing member 91 is not fixed to the cover 90 in a standing state as illustrated in FIG. 3B. The pushing member 91 is foldable and switchable between the standing state and a retracted state. The pushing member 91 is in the retracted state at the factory shipment. When the pushing member 91 is in the retracted state, the lever 39 in the retracted state as illustrated in FIG. 4 is not pushed by the pushing member 91 in the closed state of the cover 90. Accordingly, the discharge port 36 and the collection port 37 remain closed. The image forming apparatus 100 is shipped from a factory in a state in which the toner container 30 is installed in the image forming apparatus 100 with the discharge port 36 and the collection port 37 closed by the first and second container shutters 40 and 41. Therefore, it is unnecessary to pack and ship the image forming apparatus 100 and the toner container 30 separately, and toner does not leak from the toner container 30 installed in the image forming apparatus 100 due to vibration during transport.

After arrival of the image forming apparatus 100 to a user, the user (or a technician) rotates the pushing member 91 to the standing state. This operation to rotate the pushing member 91 to the standing state is performed in a state in which the cover 90 is open (and the first and second container shutters 40 and 41 remain closed). As the user (or the technician) only closes the cover 90 after erecting the pushing member 91, the first and second container shutters 40 and 41 open. As a result, toner is supplied from the toner container 30 to the empty developing device 5, and the developing device 5 becomes available in use.

Figure 16:
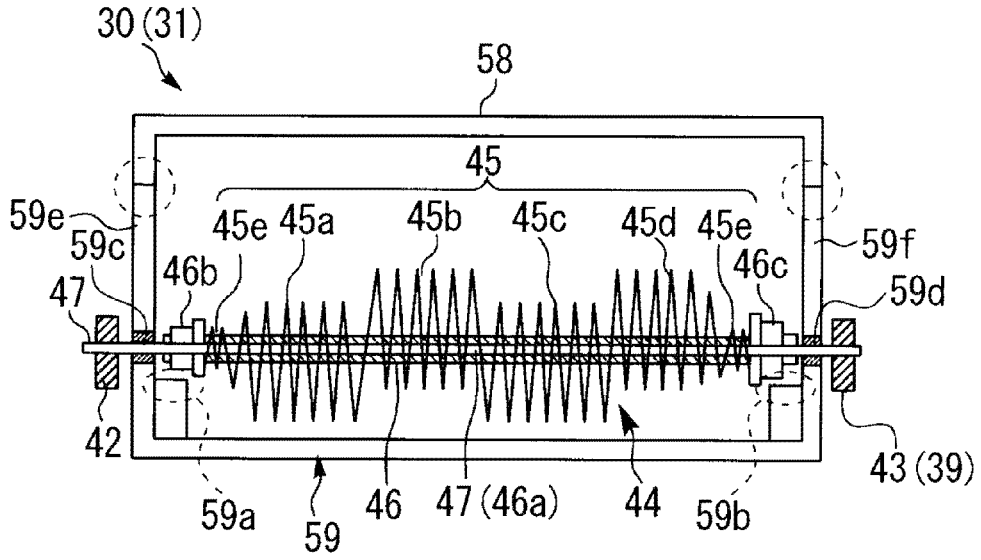
FIG. 16 a schematic view illustrating a toner storage of the toner container.
Figure 17:
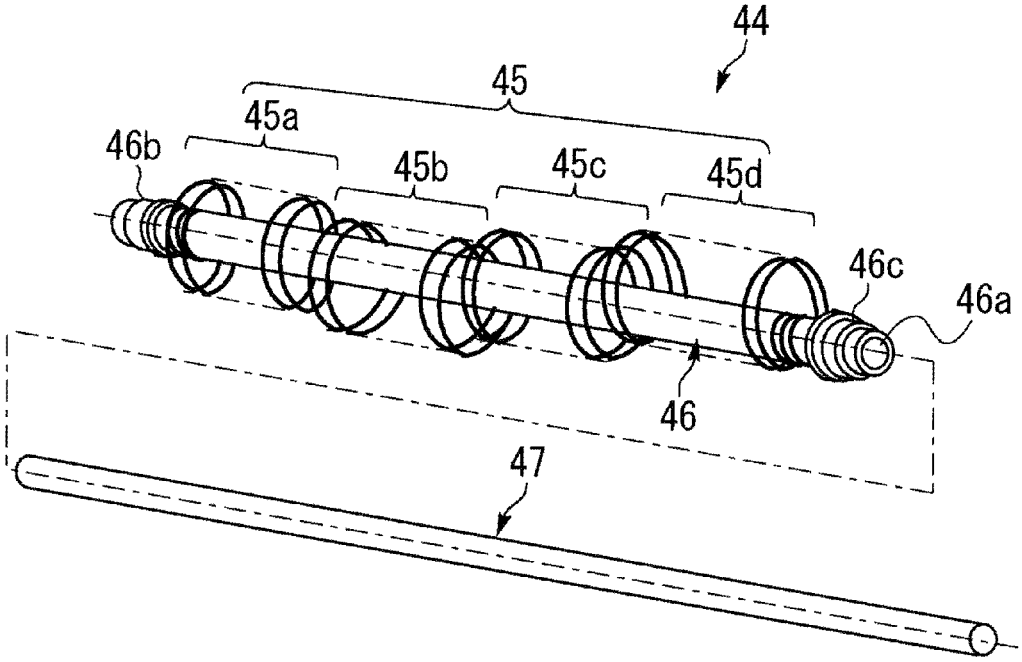
FIG. 17 is a perspective view of a coil-shaped stirrer of the toner container.
Figure 18:
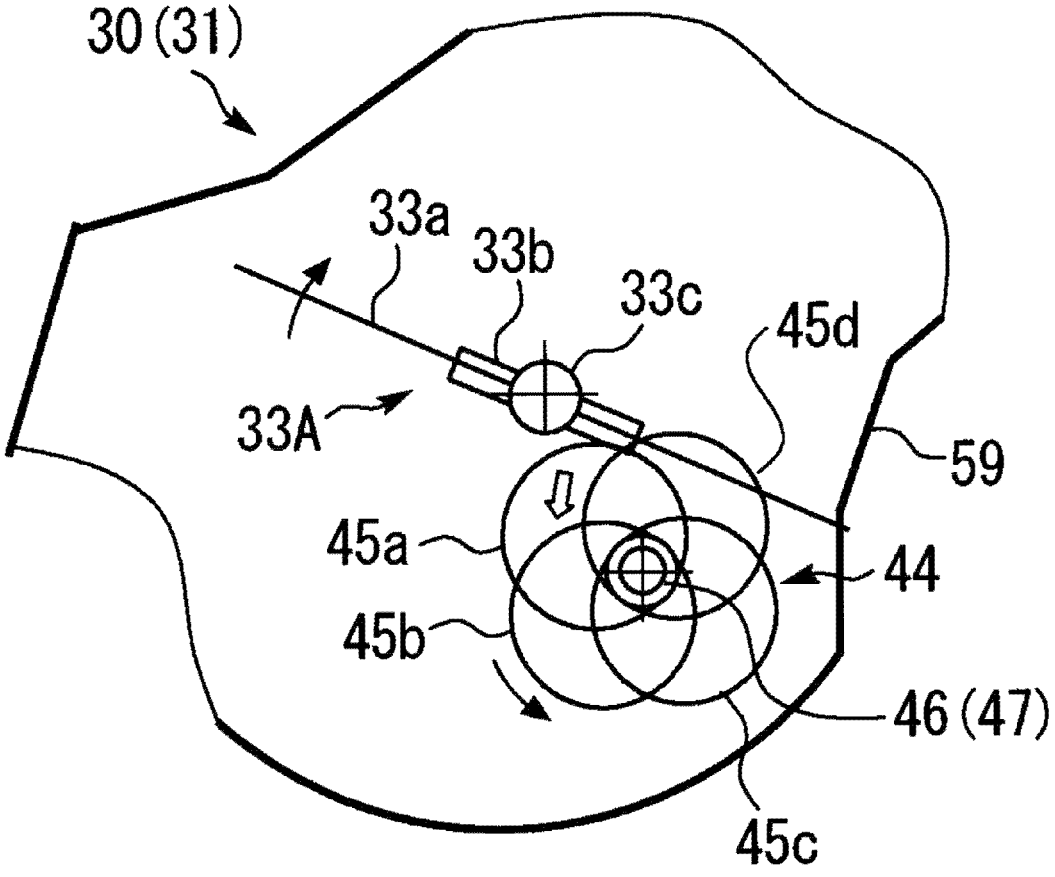
FIG. 18 is a schematic view of the first stirrer and the coil-shaped stirrer.

With reference to FIGS. 16 to 18, it can be seen that the coil 45 is held by the hollow member 46 having an axial center coincident with a center of rotation of the coil 45. The coil 45 and the hollow member 46 constitute the coil-shaped stirrer 44 to rotate around the center of rotation. In other words, the coil-shaped stirrer 44 is a stirrer including the coil 45 and the hollow member 46 and stirs toner stored in the toner container 30 (toner storage 31) together with the first and second stirrers 33A and 33B. Note that, in FIG. 18, the second stirrer 33B is omitted for simplicity.

The first stirrer 33A is the agitator including the rigid body 33*b* as the contact part to rotate the coil 45 (coil-shaped stirrer 44) by contact with the coil 45 and the flexible member 33*a* attached to the rigid body 33*b*. The flexible member 33*a* of the first stirrer 33A (and the flexible member of the second stirrer 33B) bends when contacting the coil-shaped stirrer 44. The flexible member 33*a* is flexible enough not to scratch the coil-shaped stirrer 44 and stiff enough to stir toner stored in the toner storage 31.

Inside the hollow member 46 of the coil-shaped stirrer 44, a hollow part 46*a* extends in the direction of axis of the coil-shaped stirrer 44 (in the left and right direction in FIG. 16 and perpendicular to the surface of the paper on which FIG. 18 is drawn). Held parts 46*b* and 46*c* are disposed at one end of the coil-shaped stirrer 44 and the other end of the coil-shaped stirrer 44 in the direction of axis of the coil-shaped stirrer 44, respectively.

The hollow member 46 may be made of resin. The held parts 46*b* and 46*c* at the both ends of the coil-shaped stirrer 44 have a larger outer diameter than the main part of the hollow member 46 (portion around which the coil 45 winds). The hollow part 46*a* penetrates the hollow member 46 from the one end to the other end of the coil-shaped stirrer 44. The held parts 46*b* and 46*c* are used when the coil-shaped stirrer 44 or the piercing shaft 47 is assembled to the toner container 30.

The hollow part 46*a* may be anything as long as the piercing shaft 47 to be described later can be inserted into the hollow part 46*a* and is not limited to a closed space with a hollow space closed in the circumferential direction (or one not having openings except at both ends).

The coil 45 of the coil-shaped stirrer 44 includes small coils 45*e* formed at both ends of the coil 45. The small coils 45*e* have approximately the same inner diameter as the outer diameter of the hollow member 46 and fit into the hollow member 46. Thus, the coil 45 is held by the hollow member 46 so as to cover the hollow member 46.

The coil 45 rotates counterclockwise in FIG. 18 along with the hollow member 46 and functions as a main part of the coil-shaped stirrer 44. The coil-shaped stirrer 44 (coil 45) stirs toner in a region of the toner storage 31 where the first stirrer 33A does not sufficiently stir. The piercing shaft 47 is disposed in the region to rotate the first and second rotation portions 42 and 43 in conjunction with each other. That is, if only the first stirrer 33A stirs toner in the toner storage 31 without the coil-shaped stirrer 44, the first stirrer 33A contacts the piercing shaft 47, thereby forming a dead space in which the first stirrer 33A does not sufficiently stir toner (a region farther than the piercing shaft 47 based on the first stirrer 33A) in the toner storage 31. Therefore, toner staying in the dead space may be agglomerated, causing a toner supply failure. In the present embodiment, since the coil-shaped stirrer 44 sufficiently stirs toner, such a dead space is not formed, thereby preventing toner from being agglomerated in the toner container 30 (toner storage 31).

In the present embodiment, the piercing shaft 47 is inserted into the hollow part 46*a* of the hollow member 46 of the coil-shaped stirrer 44. The piercing shaft 47 and the coil-shaped stirrer 44 (hollow member 46) independently rotate each other.

Specifically, the shaft cross-section of the piercing shaft 47 is circular, and the hole cross-section of the hollow part 46*a* of the hollow member 46 is circular. The hole cross-section has a slightly larger diameter than the shaft cross-section. With such a configuration, irrespective of the rotation of the coil-shaped stirrer 44 to stir toner in the toner storage 31, the piercing shaft 47 can be rotated by the lever 39 manually operated, thereby rotating the first and second rotation portions 42 and 43 (, the first and second container shutters 40 and 41, and the first and second cartridge shutters 63 and 73) in conjunction with each other.

The coil 45 (coil-shaped stirrer 44) receives driving force and is rotated by contact of the coil 45 with the first stirrer 33A (rigid body 33*b*).

Specifically, as the driving force is transmitted from the image forming apparatus 100 to the coupling disposed at the end of the first stirrer 33A in the axial direction, the first and second stirrers 33A and 33B rotate clockwise in FIGS. 9 and 18, and the rigid body 33*b* of the first stirrer 33A impacts the coil 45 (plurality of divided coil portions 45*a* to 45*d*). The impact of the rigid body 33*b* elastically deforms the coil 45

(plurality of divided coil portions 45*a* to 45*d*), and the coil-shaped stirrer 44 (coil 45) rotates counterclockwise in FIG. 18 by repulsive force indicated by the blank arrow in FIG. 18, which is the force for the coil 45 to return to the original shape, thereby stirring toner. Since the rigid body 33*b* of the first stirrer 33A impacts the coil 45 (plurality of divided coil portions 45*a* to 45*d*) twice during one revolution of the first stirrer 33A, the coil-shaped stirrer 44 rotates slowly, and a rotational load of the first stirrer 33A does not become too large.

Thus, the coil-shaped stirrer 44 is rotated by contact of the coil-shaped stirrer 44 with the first stirrer 33A, not by gears. Therefore, a whole drive mechanism of the toner container 30 can be simplified.

In the present embodiment, even if the piercing shaft 47 is disposed away from the shaft of the first stirrer 33A, the dead space of toner is not formed in the toner storage 31. Accordingly, the opening and closing mechanism of the first and second container shutters 40 and 41 (and the first and second cartridge shutters 63 and 73) can be freely laid out. Therefore, the flexibility of design can be improved.

Note that, if the hollow member 46 completely covers the piercing shaft 47, the piercing shaft 47 that penetrates the toner storage 31 is not contaminated with toner.

The axial direction is along the center of rotation of the coil 45, the left and right direction in FIG. 16, and the same as the width direction of the toner container 30. As illustrated in FIGS. 16 to 18, in the present embodiment, the coil 45 includes the plurality of divided coil portions 45*a* to 45*d* in the axial direction.

As illustrated in FIG. 18, a plurality of coil centers of the plurality of divided coil portions 45*a* to 45*d* are eccentric relative to the center of rotation (the axial center of the hollow member 46). As illustrated in FIG. 18, the plurality of coil centers of the plurality of divided coil portions 45*a* to 45*d* are disposed surrounding the center of rotation as viewed in the axial direction of the coil-shaped stirrer 44.

If the center of a coil is not eccentric on a circle concentric to the outer circumference of the hollow member 46 and uniformly disposed across the axial direction of the coil, the coil that the first stirrer 33A impacts is bent at a center portion in the axial direction of the coil and buried in toner in the toner storage 31, causing a state in which the coil stops rotating (or a state in which the coil does not smoothly rotate). In other words, a part of the coil remains deformed, causing a stirring failure such as rotation stop.

In the present embodiment, four divided coil portions 45*a* to 45*d* are eccentric in different directions, respectively, thereby preventing the above-described inconvenience.

In the present embodiment, the first stirrer 33A (rigid body 33*b*) impacts one of the four divided coil portions 45*a* to 45*d* at a time, thereby reducing a load of impact.

With reference to FIG. 16, the toner container 30 (toner storage 31) further includes holders 59*a* and 59*b* to hold the held parts 46*b* and 46*c* of the hollow member 46 at one end of the coil-shaped stirrer 44 and the other end of the coil-shaped stirrer 44 in the axial direction, respectively, thereby holding the coil-shaped stirrer 44.

The piercing shaft 47 is inserted into the hollow part 46*a* of the hollow member 46 from the outside of the toner container 30 through a through-hole 59*d* and holds the coil-shaped stirrer 44 while the coil-shaped stirrer 44 is held by the holders 59*a* and 59*b*.

Specifically, the toner container 30 (toner storage 31) can be divided into an upper case 58 and a lower case 59 as illustrated in FIGS. 9 and 16. The lower case 59 is a box-shaped case including a bottom, and side walls 59*e*, 59*f*, and the like, surrounding the four sides of the bottom. The upper case 58 engages the lower case 59 at positions indicated by broken-line circles in FIGS. 9 and 16 so that the upper case 58 covers the upper opening of the lower case 59. The holders 59*a* and 59*b* and the through-holes 59*c* and 59*d* are provided in the lower case 59.

More specifically, the holders 59*a* and 59*b* are disposed inside the two side walls 59*e* and 59*f* located at both ends of the lower case 59 in the axial direction of the coil-shaped stirrer 44 and have a concave shape facing upward. The holders 59*a* and 59*b* have a substantially arc-shaped cross-section.

With reference to FIG. 16, it can be seen that the through-holes 59*c* and 59*d* are disposed in the two side walls 59*e* and 59*f* located at the both ends of the lower case 59 in the axial direction of the coil-shaped stirrer 44 and at positions higher than (above) the holders 59*a* and 59*b* so as to penetrate the side walls 59*e* and 59*f*. In the present embodiment, the through-holes 59*c* and 59*d* are holes of bearings and indirectly formed in the side walls 59*e* and 59*f*. Alternatively, through-holes can be directly formed in the side walls 59*e* and 59*f*. Packings, such as G seals, V rings, or the like, are preferably provided with the through-holes 59*c* and 59*d* to prevent toner from leaking through a gap between the piercing shaft 47 and the through-holes 59*c* and 59*d*.

A length of the coil-shaped stirrer 44 is shorter than a distance between inner surfaces of the two side walls 59*e* and 59*f* in the axial direction of the coil-shaped stirrer 44. A length of the piercing shaft 47 is longer than a distance between outer surfaces of the two side walls 59*e* and 59*f* in the axial direction of the coil-shaped stirrer 44.

In the process of manufacturing the toner container 30, the coil-shaped stirrer 44 is placed in the lower case 59 from above with the upper case 58 removed so that the held parts 46*b* and 46*c* of the hollow member 46 fit to the holders 59*a* and 59*b* of the lower case 59.

The piercing shaft 47 is inserted into the hollow part 46*a* of the coil-shaped stirrer 44 placed in the lower case 59, from the outside of the toner container 30 through one of the through-holes 59*c* and 59*d* of the two side walls 59*e* and 59*f*. Then, the piercing shaft 47 penetrates the through-holes 59*c* and 59*d* of the two side walls 59*e* and 59*f* and is held by the lower case 59.

Thus, the toner container 30 according to the present embodiment includes the piercing shaft 47 that is inserted into the hollow part 46*a* of the hollow member 46 from the outside of the toner container 30 through the through-hole 59*d* while the coil-shaped stirrer 44 is held by the holders 59*a* and 59*b* and holds the coil-shaped stirrer 44.

Therefore, even if the coil-shaped stirrer 44 is rotatably held in the toner container 30 that is box-shaped, inconveniences, such as that it takes time and effort to assemble the toner container 30 or an assembly failure occurs in the manufacturing process, do not occur, thereby improving assembly efficiency of the toner container 30.

The coil-shaped stirrer 44 according to the present embodiment includes the coil 45. In a case of assembly of the piercing shaft 47 without the hollow member 46 and the holders 59*a* and 59*b*, an operator inserts the piercing shaft 47 into the interior of the coil 45 from the outside of the toner container 30, while holding the coil 45 by hand by the operator, thus causing the piercing shaft 47 to become entangled with the coil 45, a state that cannot be ignored. In the present embodiment, since the coil 45 includes the plurality of divided coil portions 45*a* to 45*d* whose coil centers are eccentric in four directions, the piercing shaft 47 is more likely to be entangled with the divided coil portions 45*a* to 45*d* without the hollow member 46 when inserted.

On the other hand, in the present embodiment, since the piercing shaft 47 moves inside the hollow member 46 in series of operations in which the piercing shaft 47 is inserted into the coil-shaped stirrer 44 (coil 45), the piercing shaft 47 is not entangled with the coil 45. Therefore, the assembly efficiency of the toner container 30 is improved.

The configuration and operation of the toner container 30 as the powder container according to the present embodiment are described in detail below.

As described above, in the present embodiment, the toner container 30 as the powder container is detachably attachable to the process cartridge 10 as the removable component.

Figure 19:
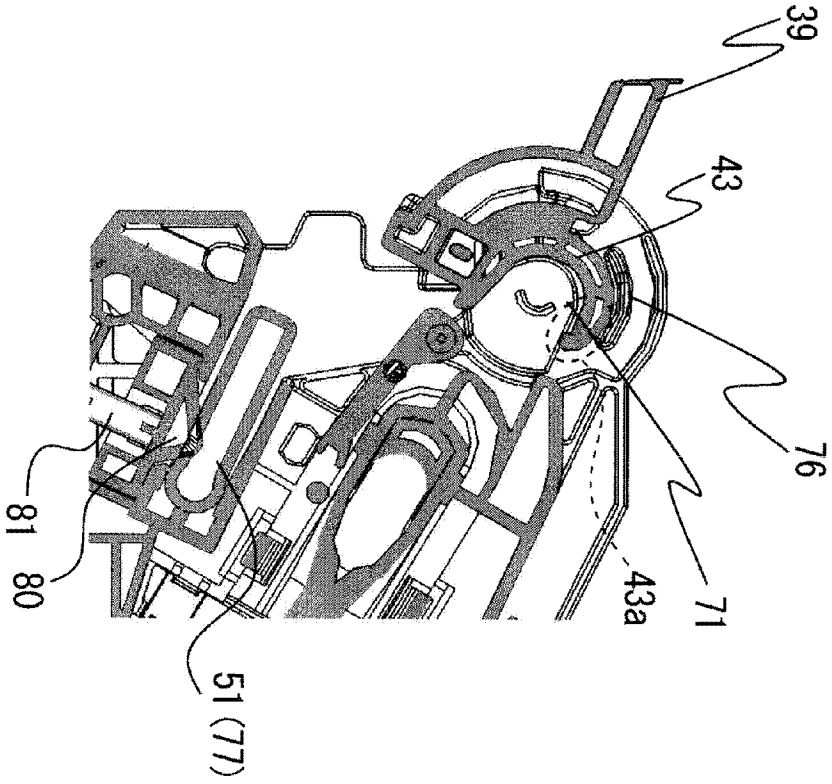
FIG. 19 is a cross-sectional view illustrating a state in which the second rotation portion maintains a posture in a direction of attachment of the toner container and is rotatable together with the second engagement portion while engaging the second engagement portion.
Figure 20:
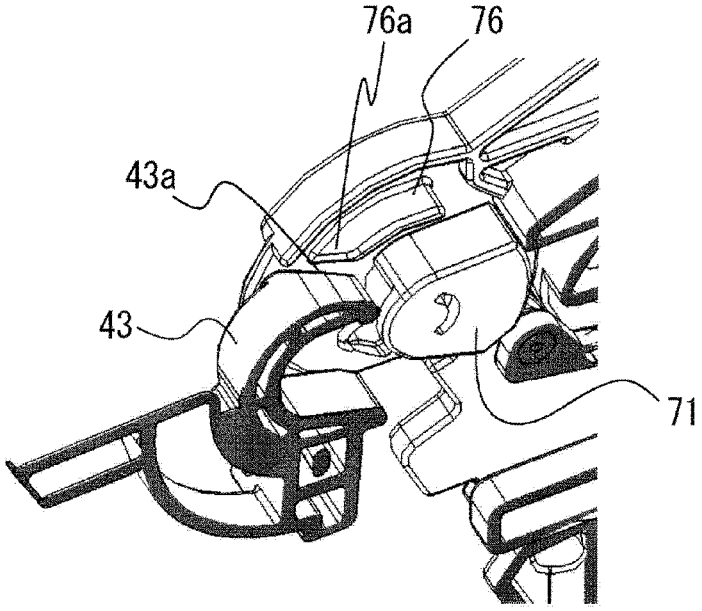
FIG. 20 is a cross-sectional perspective view illustrating a state immediately before the second rotation portion engages the second engagement portion at the time of attachment.
Figure 21:
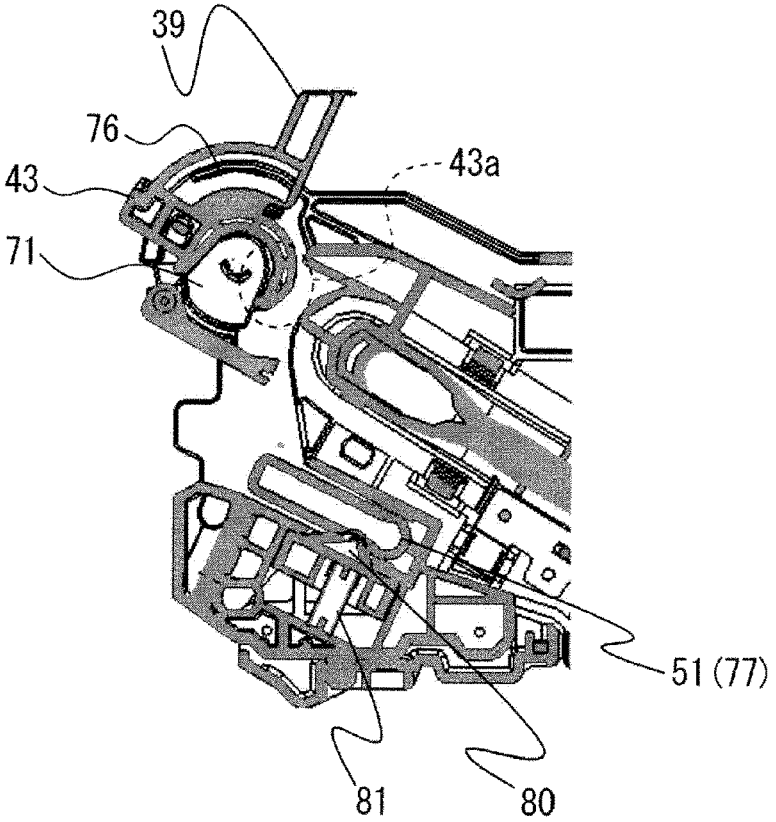
FIG. 21 is a cross-sectional view illustrating a state in which the second rotation portion engaging the second engagement portion has been completely rotated by an operation of an operation device of the toner container at the time of attachment.

Further, with reference to FIGS. 19 to 21 (and FIGS. 11A to 12B), the process cartridge 10 as the removable component includes the second engagement portion 71 that is rotatable. The projecting end of the second engagement portion 71 has a substantially arc shape with an opening angle of about 90 to 120 degrees.

The toner container (powder container) 30 includes the second rotation portion 43 that is engageable with the second engagement portion 71 and rotates in conjunction with the operation of the lever 39 as the operation device. The second rotation portion 43 is substantially C-shaped so as to match the shape of the projecting end of the second engagement portion 71.

Here, with reference to FIGS. 19 to 22 (and FIGS. 11A and 11B), it can be seen that, in the present embodiment, the process cartridge 10 as the removable component includes a wall 76 opposed to the second engagement portion 71.

The wall 76 has a substantially arc shape at a position away from the second engagement portion 71 so as to match the shape of the projecting end of the second engagement portion 71. Specifically, the wall 76 is disposed at a substantially constant distance from the center of rotation of the second engagement portion 71 and has a substantially arc shape with an opening angle of about 30 to 60 degrees. The wall 76 stands inward (positive Y-direction) on an inner surface of the side wall of the process cartridge 10. The second engagement portion 71 is rotatably supported by the side wall of the process cartridge 10. The wall 76 is provided on the side where the lever 39 rotates after the toner container 30 is attached to the process cartridge 10 (i.e., above the second engagement portion 71 in FIG. 19).

In the toner container (powder container) 30 according to the present embodiment, the second rotation portion 43 does not hinder the toner container 30 from moving toward the process cartridge 10 as the removable component in a direction of attachment of the toner container to the process cartridge 10 (i.e. attachment direction). Then, the second rotation portion 43 contacts the wall 76 in a state in which the second rotation portion 43 maintains a posture in the attachment direction and is rotatable together with the second engagement portion 71 while engaging the second engagement portion 71. As a result, the toner container 30 is restrained from moving in a direction of detachment of the toner container from the process cartridge 10 (i.e. detachment direction).

Specifically, with reference to FIG. 20, the second rotation portion 43 has a substantially C-shape, and a part of the second rotation portion 43 that firstly contacts or approaches the wall 76 at the time of attachment of the powder container is tapered. That is, the second rotation portion 43 includes a taper part (inclined part) 43*a* that firstly contacts the wall 76 at the time of attachment.

More specifically, the taper part 43*a*, which is a projecting end of the C shape of the second rotation portion 43, has a thickness gradually decreases toward the projecting end from the outer peripheral surface on the side where the lever 39 rotates after the toner container 30 is attached to the process cartridge 10 (i.e., above the second engagement portion 71 in FIG. 19).

Owing to the taper part 43*a* of the second rotation portion 43, when the toner container 30 is attached to the process cartridge 10, as illustrated in FIG. 20, the second rotation portion 43 (taper part 43*a*) does not interfere with a tip 76*a* of the wall 76 (, or even if the second rotation portion 43 comes into contact with the tip 76*a* of the wall, the taper part 43*a* only slidingly contacts the tip 76*a*). Then, as illustrated in FIG. 19 the second rotation portion 43 engages the second engagement portion 71. That is, at the time of attachment, there is almost no contact friction resistance between the second rotation portion 43 and the wall 76, and the toner container 30 is not hindered from moving in the direction in which the toner container 30 is attached to the process cartridge 10.

As illustrated in FIG. 19, in a state in which the second rotation portion 43 engages the second engagement portion 71 (before the lever 39 is rotated and the attachment of the toner container 30 is completed), a certain amount of force is required to remove the toner container 30 from the process cartridge 10 in the direction of detachment of the toner container 30 because a part of the second rotation portion 43 is sandwiched (caught) between the second engagement portion 71 and the wall 76 when viewed from the direction of detachment. That is, as illustrated in FIG. 19, the second rotation portion 43 contacts (interferes with) the wall 76 in a state in which the second rotation portion 43 maintains the posture in the direction of attachment of the toner container 30 to the process cartridge 10 and is rotatable together with the second engagement portion 71 while engaging the second engagement portion 71, thereby restraining the toner container 30 from moving in the direction of detachment of the toner container 30 from the process cartridge 10.

Therefore, even if an operator attaches the toner container 30 to the process cartridge 10 and forgets to rotate the lever (operation device) 39, the toner container 30 is locked to a certain degree to the process cartridge 10. Accordingly, the toner container 30 does not easily fall off. As a result, inconveniences are not likely to occur that the toner container 30 falls off the process cartridge 10 contrary to the operator's intention and the toner container 30 is broken or toner leaks out from the toner container 30.

As the lever 39 rotates from the state in FIG. 19 to a state in which the second rotation portion 43 rotates together with the second engagement portion 71 as illustrated in FIG. 21, the toner container 30 is completely attached to the process cartridge 10. With such a configuration, the second engagement portion 71 is erected like a lock pin in the direction perpendicular to the detachment direction in which the toner container 30 is pulled out from the process cartridge 10. Accordingly, it is difficult to detach the toner container 30 from the process cartridge 10.

Further, as the lever 39 rotates from the state in FIG. 19 to the state in FIG. 21, the second container shutter 41 (collection port 37) and the second cartridge shutter 73 (outlet port 74) are opened as described above with reference to FIGS. 11A to 12B.

Figure 13:
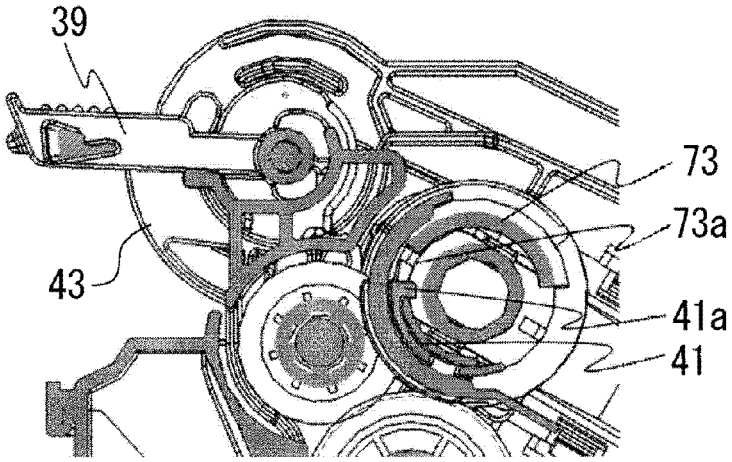
FIG. 13 is a cross-sectional view illustrating an engagement in which a projection of the second container shutter fits into a slot of the second cartridge shutter.

With reference to FIG. 13, it can be seen that, in the present embodiment, the projection 41*a* of the second container shutter 41 fits into a slot 73*a* of the second cartridge shutter 73 in conjunction with the attachment of the toner container 30 to the process cartridge 10. Accordingly, the second container shutter 41 and the second cartridge shutter 73 is opened and closed in conjunction with the rotation of the second rotation portion 43 and the second engagement portion 71 and the movement of the second link 72 accompanying the rotation operation of the lever 39.

Figure 14:
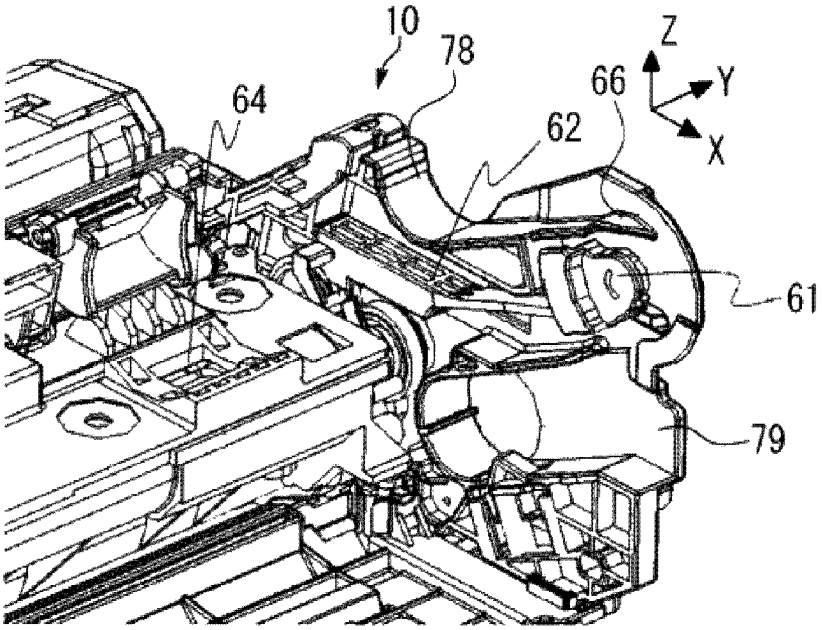
FIG. 14 is an enlarged perspective view illustrating a first engagement portion of the process cartridge and surrounding structure.

As described above with reference to FIGS. 14 to 15B, the process cartridge 10 as the removable component according to the present embodiment includes the first engagement portion 61 that is rotatable. As illustrated in FIG. 14, the process cartridge 10 includes another wall 66 opposed to the first engagement portion 61. Since the relation between the first engagement portion 61 and the another wall 66 is equivalent to the relation between the second engagement portion 71 and the wall 76, detailed description thereof is omitted.

Further, as described above, the toner container (powder container) 30 includes the first rotation portion 42 that is engageable with the first engagement portion 61. The first rotation portion 42 is coupled to the second rotation portion 43 via the piercing shaft 47 and rotates in conjunction with the operation of the lever 39.

In the present embodiment, the first rotation portion 42 does not hinder the toner container 30 from moving in the direction in which toner container 30 is attached to the process cartridge 10 (i.e. attachment direction). Then, the first rotation portion 42 contacts the another wall 66 in a state in which the first rotation portion 42 maintains the posture in the attachment direction and is rotatable together with the first engagement portion 61 while engaging the first engagement portion 61. As a result, the toner container 30 is restrained from moving in the direction in which the toner container is detached from the process cartridge 10 (i.e. detachment direction).

That is, the pair of rotation portions (i.e., first and second rotation portions 42 and 43) disposed at both ends in the width direction has a similar configuration and functions in substantially the same manner.

Therefore, even if an operator attaches the toner container 30 to the process cartridge 10 and forgets to rotate the lever 39, the another wall 66 interferes with the first rotation portion 42. Accordingly, the toner container 30 is difficult to fall off the process cartridge 10.

Figure 23:
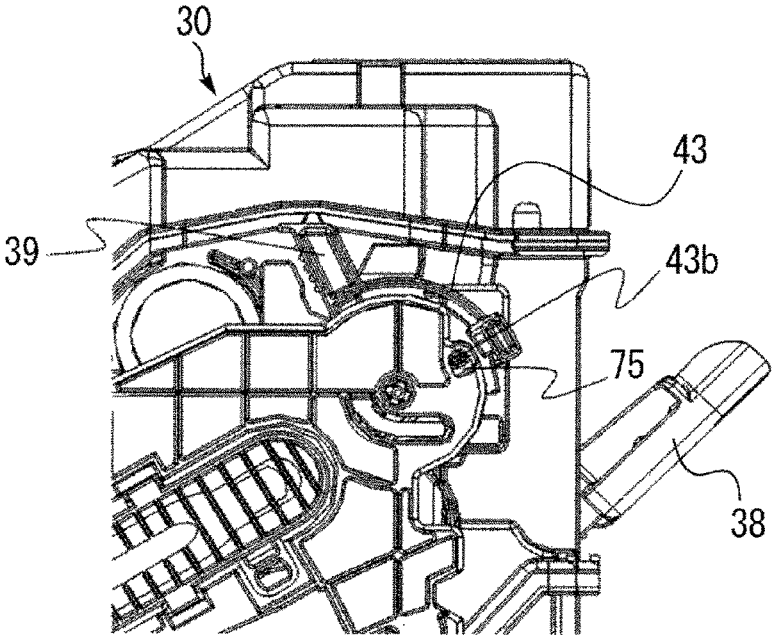
FIG. 23 is a side view illustrating a state in which a protrusion of the second rotation portion fits into a hole of the process cartridge and the rotation of the second rotation portion is completed at the time of attachment.

Here, with reference to FIG. 23 (and FIG. 8), in the present embodiment, when the second rotation portion 43 is rotated together with the second engagement portion 71 by the operation of the lever 39 after the second rotation portion 43 is moved in the attachment direction and engaged with the second engagement portion 71 (i.e., when in a state in FIG. 21), a protrusion 43*b* of the second rotation portion 43, which is a substantially hemispherical protrusion, fits into a hole 75 disposed in the side wall of the process cartridge 10.

With this configuration, the lever 39 is locked in the state FIGS. 21 and 23, and an operator can feel a click, thereby completing the operation of the lever 39 reliably. Further, the lever 39 is less likely to be erroneously rotated counterclockwise in FIGS. 21 and 23.

Here, with reference to FIGS. 19 and 21, the process cartridge 10 according to the present embodiment includes a biasing member to press the toner container 30 in a state in which the second rotation portion 43 is rotatable together with the second engagement portion 71 while engaging the second engagement portion 71, in the direction in which the second rotation portion 43 contacts the wall 76.

Specifically, the biasing member includes a compression spring 81 and a pushing member 80. One end of the compression spring 81 is secured to the housing of the process cartridge 10, and the pushing member 80 is coupled to the other end of the compression spring 81. The pushing member 80 has a substantially triangular (or mountain-shaped) cross section, and the top of the pushing member 80 protrudes through an opening of the guide groove 77 so as to contact the guide 51 of the toner container 30.

With such a configuration, the toner container 30 in a state in which the second rotation portion 43 is rotatable together with the second engagement portion 71 while engaging the second engagement portion 71 is pressed in the direction in which the second rotation portion 43 contacts the wall 76 while the pushing member 80 coupled to the compression spring 81 presses the guide 51 upward. As a result, when the second rotation portion 43 is rotatable together with the second engagement portion 71 while engaging the second engagement portion 71, the second rotation portion 43 interferes with the wall 76. Accordingly, it is difficult to remove the toner container 30 from the process cartridge 10.

Figure 22:
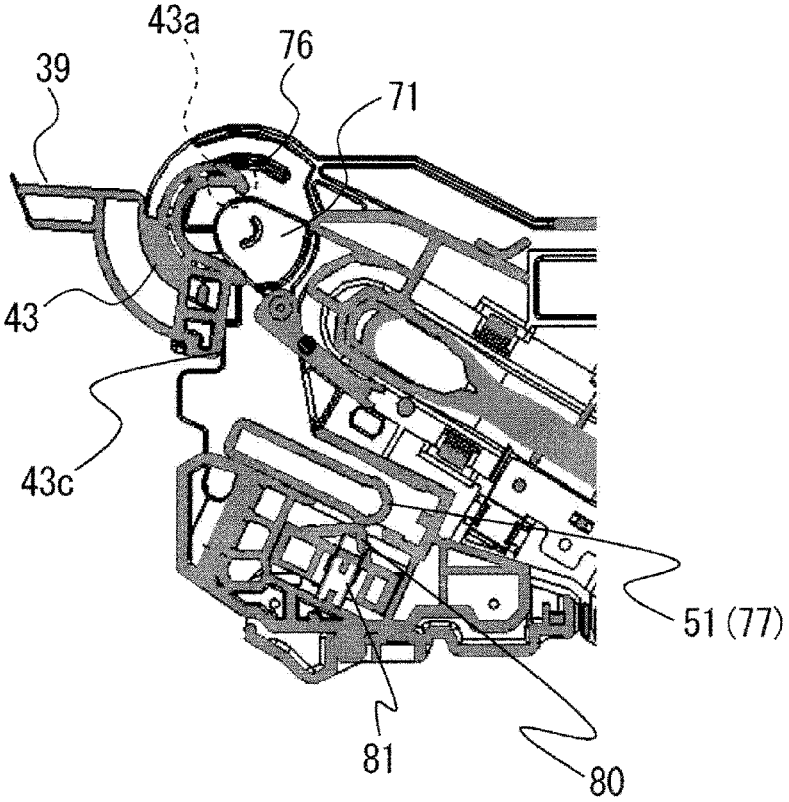
FIG. 22 is a cross-sectional view illustrating a state in which the second rotation portion is rotated around a fulcrum of the second rotation portion by the operation of the operation device at the time of detachment.

In the present embodiment, as illustrated in FIG. 22, the second rotation portion 43 includes a fulcrum (contact part) 43*c*. When the second rotation portion 43 is rotated away from the wall 76 by the operation of the lever 39 as the operation device (i.e., counterclockwise in FIG. 22), the fulcrum 43*c* contacts the process cartridge 10 and the second rotation portion 43 is rotated around the fulcrum 43*c* while the toner container 30 is pressed in the detachment direction (to the left in FIG. 22) by the biasing member (i.e., the compression spring 81 and the pushing member 80).

Specifically, when the toner container 30 is detached from the process cartridge 10, as the lever 39 located at the rotation position in FIG. 21 (setting completion position) is rotated counterclockwise in FIG. 22, the second rotation portion 43 is rotated together with the second engagement portion 71 counterclockwise, and eventually the second engagement portion 71 comes into contact with a stopper portion of the process cartridge 10, thereby restricting the rotation of the second engagement portion 71. On the other hand, the second rotation portion 43 is rotated away from the wall 76 around the fulcrum 43*c*. At that time, when the guide 51 moves diagonally to the upper left in FIG. 22 along the guide groove 77 and eventually the guide 51 exceeds the top of the pushing member 80, the guide 51 comes into contact with the inclined surface of the mountain-shaped pushing member 80, thereby pressing the guide 51 obliquely upward to the left. Accordingly, while the toner container 30 is pressed in the detachment direction by the biasing member (i.e., the pushing member 80 and the compression spring 81) to facilitate the detachment of the toner container 30, the second rotation portion 43 is rotated away from the wall 76 around the fulcrum 43*c* and moved in the detachment direction. To perform such an operation efficiently, as illustrated in FIG. 22, when the fulcrum 43*c* contacts the process cartridge 10 and serves as the fulcrum of the above-described rotation operation, the fulcrum 43*c* is preferably arranged far below the lever 39 and the substantially C-shaped part which contacts the second engagement portion 71.

Therefore, the toner container 30 can be smoothly detached from the process cartridge 10.

This configuration can be applied to the first rotation portion 42 and the first engagement portion 61 on the side opposite to the second rotation portion 43 and the second engagement portion 71.

Figure 24:
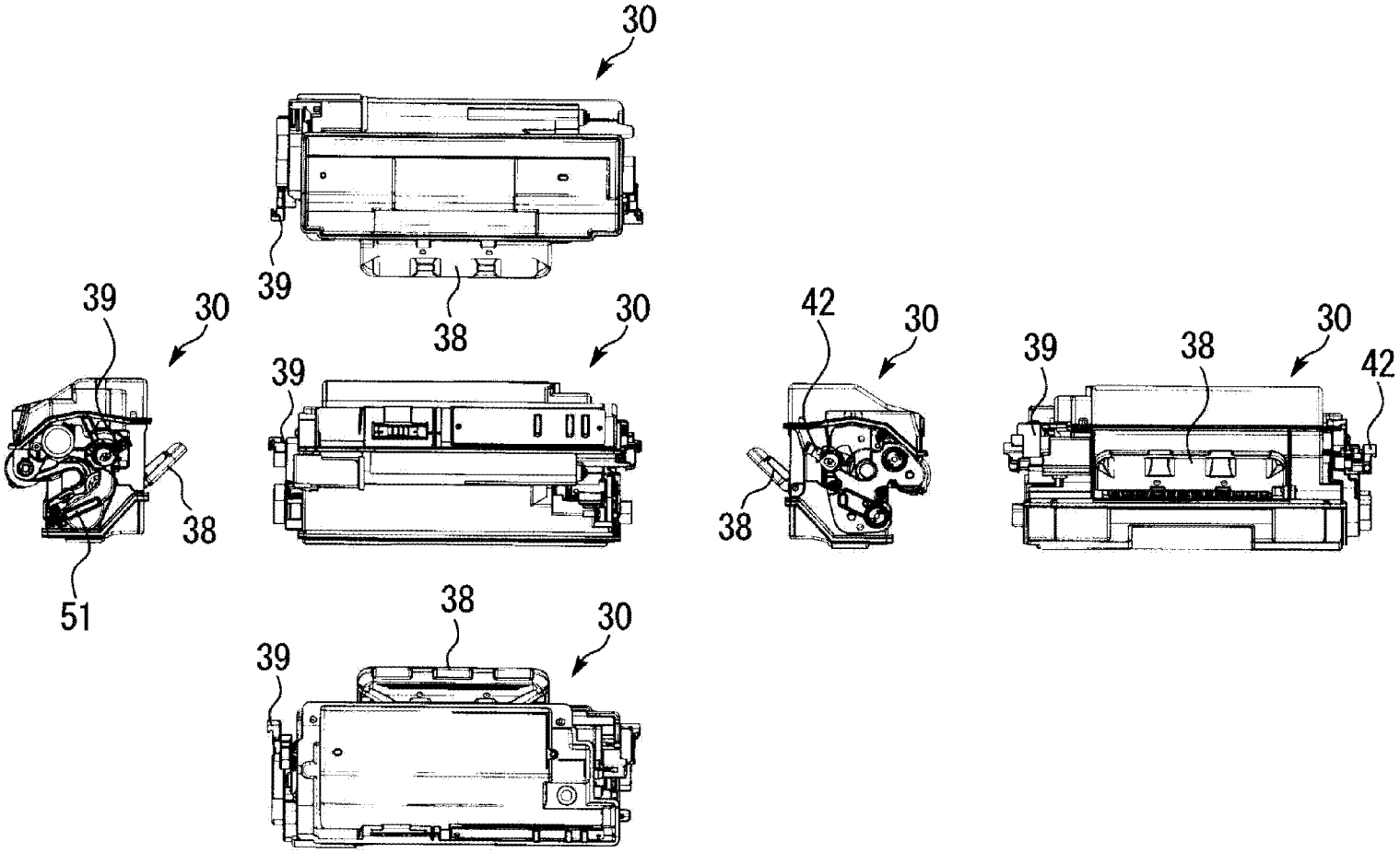
FIG. 24 provides six schematic views of a powder container according to an embodiment of the present disclosure.
Figure 25A:
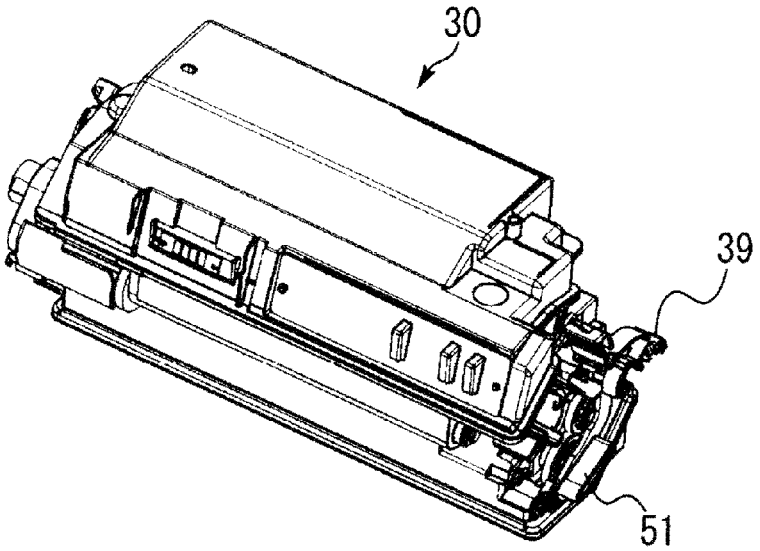
FIGS. 25A and 25B are perspective views of the powder container in FIG. 24.
Figure 25B:
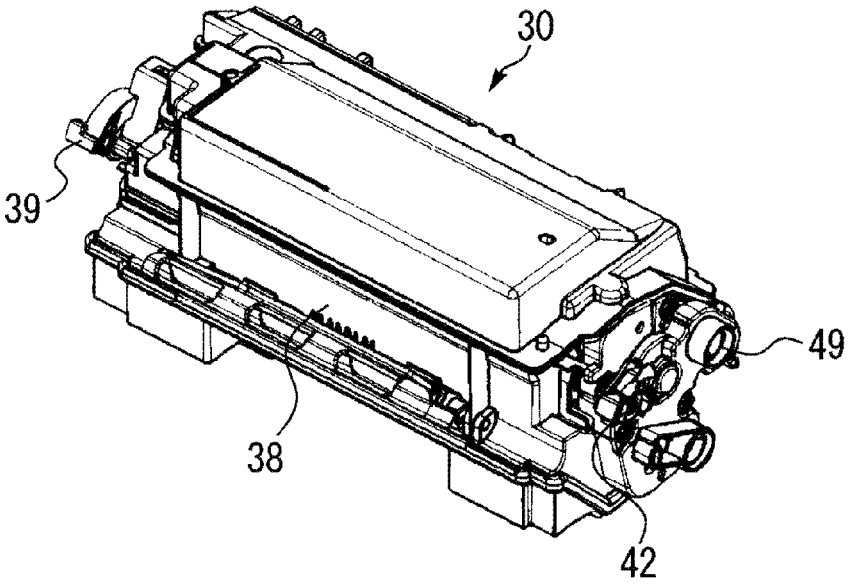

FIG. 24 provides six views (a front view, a top view, a bottom view, a right side view, a left side view, and a rear view) illustrating the toner container (powder container) 30 according to the present embodiment. FIGS. 25A and 25B are perspective views illustrating the toner container 30 in FIG. 24 as viewed from different directions.

Figure 26:
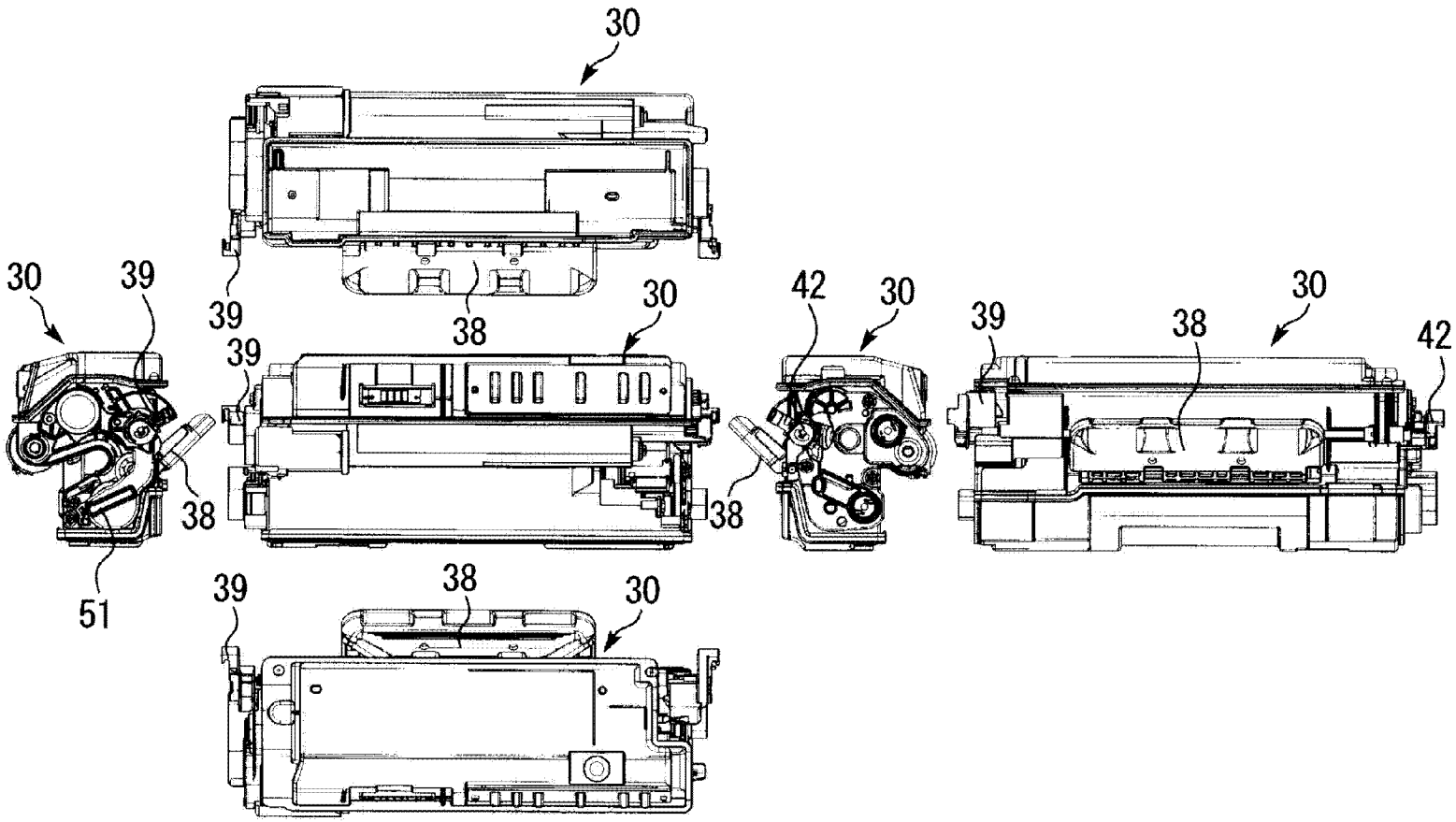
FIG. 26 provides six schematic views of a powder container according to another embodiment of the present disclosure.
Figure 27A:
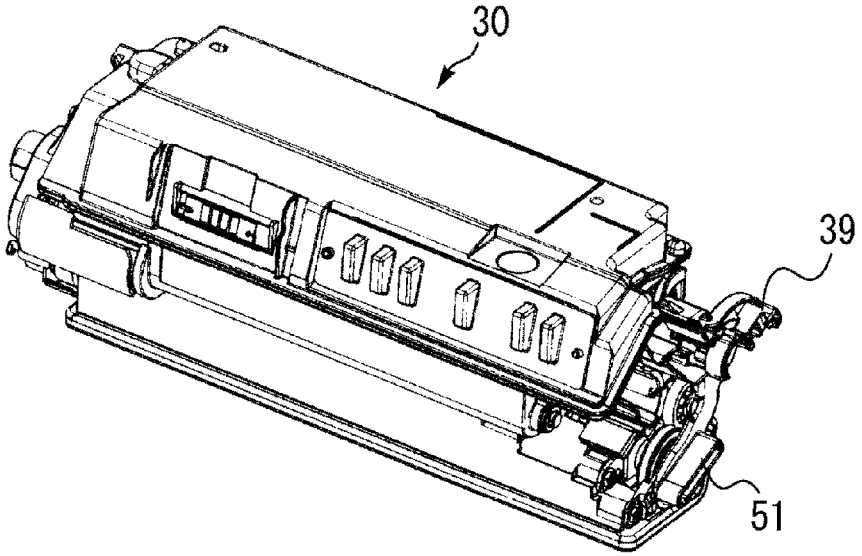
FIGS. 27A and 27B are perspective views of the powder container in FIG. 26.
Figure 27B:
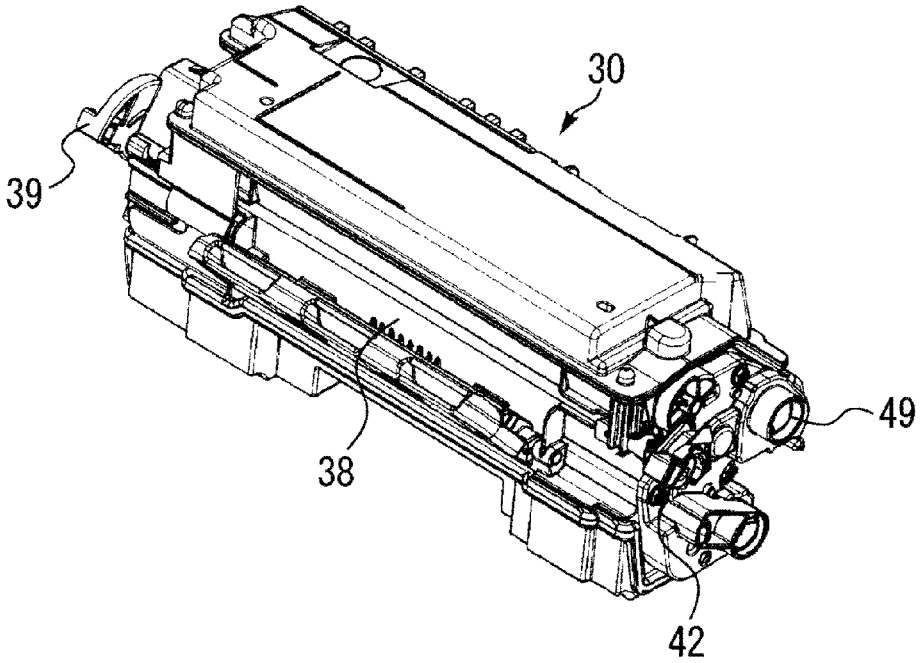

FIG. 26 provides six views of a toner container (powder container) 30 according to another embodiment. FIGS. 27A and 27B are perspective views illustrating the toner container 30 in FIG. 26 as viewed from different directions. The toner container 30 illustrated in FIGS. 26 to 27B has substantially the same configuration as the toner container 30 illustrated in FIGS. 24 to 25B except that the maximum amount of toner contained therein is smaller than that illustrated in FIGS. 24 and 25. In particular, the both toner containers 30 have the configuration according to the present disclosure equally.

As described above, in the toner container (powder container) 30 according to the present embodiment, the second rotation portion 43 (or the first rotation portion 42) does not hinder the toner container (powder container) 30 from moving in the direction of attachment of the toner container to the process cartridge 10 (i.e. attachment direction). Then, the second rotation portion 43 (or the first rotation portion 42) contacts the wall 76 (or the another wall 66) in a state in which the second rotation portion 43 (or the first rotation portion 42) maintains the posture in the attachment direction and is rotatable together with the second engagement portion 71 (or the first engagement portion 61) while engaging the second engagement portion 71 (or the first engagement portion 61). As a result, the toner container 30 (powder container) is restrained from moving in the direction of detachment of the toner container (powder container) 30 from the process cartridge 10 (i.e. detachment direction).

As a result, the toner container 30 is not likely to fall off the process cartridge 10 even if the lever 39 as the operation device is not operated after attachment of the toner container 30 to the process cartridge 10.

Therefore, a powder container, a process cartridge, and an image forming apparatus can be provided that prevent the powder container from falling off the one of the image forming apparatus and the removable component if the operation device is not operated after attachment of the powder container to the one of the image forming apparatus and the removable component.

In the above-described embodiments, the present disclosure is applied to the process cartridge 10 as a single unit including the photoconductor drum (image bearer) 1, the charging roller (charger) 4, the developing device 5, the cleaner 2, and the excess toner conveyor 6. However, the present disclosure is not limited to the embodiments described above and can be applied to the image forming apparatus 100 in which the above-describe devices (i.e., the photoconductor drum 1, the charging roller 4, the developing device 5, the cleaner 2, and the excess toner conveyor 6) are removably installed as a single unit, respectively.

In such configurations, effects similar to those of the above-described embodiments are also attained.

It is to be noted that the term "process cartridge" used in the present disclosure means a removable component (removable unit) including an image bearer and at least one of a charger to charge the image bearer, a developing device to develop latent images on the image bearer, and a cleaner to clean the image bearer that are united together, and is designed to be removably installed as a united part in the image forming apparatus.

In the above-described embodiments, the present disclosure is applied to the toner container (powder container) 30 included in the image forming apparatus 100 that performs monochrome image formation. Alternatively, the present disclosure may also be applied readily to a toner container (powder container) included in a color image forming apparatus.

In the above-described embodiments, the present disclosure is applied to the toner container (powder container) 30 indirectly installed in and removed from the image forming apparatus 100 via the process cartridge 10. Alternatively, the present disclosure may be applied to a toner container (powder container) directly installed in and removed from an image forming apparatus without going through the process cartridge.

In the above-described embodiments, the present disclosure is applied to the toner container (powder container) 30 to store toner (one-component developer) and supply the toner to the developing device 5 for a one-component developing method. Alternatively, the present disclosure may be applied to a toner container (powder container) to supply toner to a developing device for a two-component developing method.

In the above-described embodiments, the present disclosure is applied to the toner container (powder container) 30 in which toner (one-component developer) as powder is stored and collected. Alternatively, the present disclosure may be applied to a powder container in which a two-component developer as powder is stored and collected. The two-component developer is a mixture of toner and carrier. In this case, a developing device employs the two-component developing method.

In the above-described embodiments, the present disclosure is applied to the toner container (powder container) 30 including the toner storage 31 and the excess toner collection portion 32 as a single unit. Alternatively, the present disclosure may be applied to a toner container (powder container) including only a toner storage (powder storage).

All of the cases described above exhibit effects similar to those of the above-described embodiments.

In the above-described embodiments, the present disclosure is applied to the toner container 30 (toner storage 31) to supply toner as powder to the developing device 5, but a powder container to which the present disclosure is applied is not limited thereto. Alternatively, the present disclosure may be applied to a developing device to store toner as powder and develop a latent image formed on an image bearer to a toner image (for example, the developing device 5 in the above-described embodiments). Further, the present disclosure is applied to other powder containers (for example, the cleaner 2 or the excess toner collection portion 32 in the above-described embodiments) included in the image forming apparatus and yet other powder containers included in any device other than the image forming apparatus as long as powder is stored therein.

In the present embodiment, the lever 39 as the operation device is formed together with the second rotation portion 43 as a single unit. Alternatively, the lever 39 can be formed together with the first rotation portion 42 as a single unit.

Additionally, the above descriptions concern the toner container (powder container) 30 including the coil-shaped stirrer 44 and the first and second stirrers 33A and 33B. However, the present disclosure is applicable to a powder container without a coil-shaped stirrer, a powder container including one stirrer or three or more stirrers, and the like.

All of the cases described above exhibit effects similar to those of the above-described embodiments.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

Note that, in the present disclosure, the powder container is mainly a device to stir powder to be used in the image forming apparatus or stir the used powder in the image forming apparatus. Therefore, the powder container includes a device to stir fresh toner or fresh developer and a device to stir the used toner or used developer.

In the present disclosure, the width direction is perpendicular to the direction in which the toner container (powder container) 30 is attached to the process cartridge 10. The toner container (powder container) 30 has a longitudinal direction and a short side direction, and the width direction is the longitudinal direction of the toner container (powder container) 30. In addition, the width direction is the direction in which the shaft of the rotator, such as the first and second stirrers 33A and 33B, the coil-shaped stirrer 44, and the like, extends.

In the present disclosure, one end side in the width direction means one portion side when the toner container 30 is divided into two portions at the center of the toner container 30. In the present disclosure, the other end side in the width direction means the other portion side when the toner container 30 is divided into two portions at the center of the toner container 30.

What is claimed is:

1. A powder container configured to be detachably attached to one of an image forming apparatus and a removable component that is removably installed in the image forming apparatus; the powder container comprising:

an operation device; and a rotation portion configured to rotate in co lion with operation of the operation device, wherein an outer circumferential surface of the rotation portion is configured to contact a wall of the one of the image forming apparatus and the removable component in a state in which the rotation portion maintains a posture in a direction of attachment of the powder container to the one of the image forming apparatus and the removable component and is rotatable together with an engagement portion, which is opposed to the wall, of the one of the image forming apparatus and the removable component while engaging the engagement portion, without hindering the powder container from moving in the direction of attachment, to restrain the powder container from moving in a direction of detachment of the powder container from the one of the image forming apparatus and the removable component, and wherein the engagement portion engages with the rotation portion on an opposite side of the rotation portion from the outer circumferential surface that contacts the wall.

2. The powder container according to claim 1, wherein the rotation portion has a C shape, and wherein a part of the rotation portion that firstly contacts or approaches the wall at a time of attachment of the powder container is tapered.

3. The powder container according to claim 1, further comprising:

a discharge port configured to communicate with an inlet port of the one of the image forming apparatus and the removable component and discharge powder stored in the powder container, the inlet port configured to be opened and closed by a first cartridge shutter of the one of the image forming apparatus and the removable component;

a first container shutter configured to open and close the discharge port;

a collection port configured to communicate with an outlet port of the one of the image forming apparatus and the removable component, and to receive and collect powder flowing out through the outlet port, the outlet port configured to be opened and closed by a second cartridge shutter of the one of the image forming apparatus and the removable component;

a second container shutter configured to open and close the collection port;

another rotation portion configured to engage another engagement portion of the one of the image forming apparatus and the removable component, and to rotate in conjunction with the operation of the operation device; and a shaft configured to couple the rotation portion and said another rotation portion, wherein said another rotation portion is configured to contact another wall of the one of the image forming apparatus and the removable component in a state in which said another rotation portion maintains a posture in the direction of attachment of the powder container to the one of the image forming apparatus and the removable component and is rotatable together with said another engagement portion, which is opposed to said another wall, of the one of the image forming apparatus and the removable component while engaging said another engagement portion, without hindering the powder container from moving in the direction of attachment, to restrain the powder container from moving in the direction of detachment of the powder container from the one of the image forming apparatus and the removable component.

4. The powder container according to claim 3, wherein said another rotation portion engaging said another engagement portion is configured to rotate said another engagement portion in conjunction with the operation of the operation device and move the first cartridge shutter and the first container shutter to open and close the inlet port and the discharge port, and wherein the rotation portion engaging the engagement portion is configured to rotate the engagement portion in conjunction with the operation of the operation device and move the second cartridge shutter and the second container shutter to open and close the outlet port and the collection port.

5. The powder container according to claim 3, wherein the second container shutter includes a projection configured to fit into a slot of the second cartridge shutter in conjunction with attachment of the powder container to the one of the image forming apparatus and the removable component.

6. The powder container according to claim 3, wherein the operation device is formed together with one of the rotation portion and said another rotation portion as a single unit.

7. The powder container according to claim 1, wherein the rotation portion includes a protrusion configured to fit into a hole of the one of the image forming apparatus and the removable component when the rotation portion is rotated together with the engagement portion by the operation of the operation device after the rotation portion moves in the direction of attachment and engages the engagement portion.

8. The powder container according to claim 1, wherein the powder container is one of a developing device and a toner container, wherein the developing device is configured to store toner serving as powder and develop a latent image formed on an image bearer of the one of the image forming apparatus and the removable component, and wherein the toner container is configured to supply toner serving as powder to the developing device.

9. A process cartridge configured to be removably installable in an image forming apparatus, the process cartridge comprising:

a wall;

an engagement portion opposed to the wall;

a powder container configured to be detachably attached to the process cartridge, the powder container including:

an operation device; and a rotation portion configured to rotate in conjunction with operation of the operation device, wherein an outer circumferential surface of the rotation portion is configured to contact the wall in a state in which the rotation portion maintains a posture in a direction of attachment of the powder container to the process cartridge and is rotatable together with the engagement portion while engaging the engagement portion, without hindering the powder container from moving in the direction of attachment, to restrain the powder container from moving in a direction of detachment of the powder container from the process cartridge, and wherein the engagement portion engages the rotation portion on an opposite side of the rotation portion from the outer circumferential surface that contacts the wall.

10. The process cartridge according to claim 9, wherein the engagement portion has an arc-shaped projecting end, wherein the wall is disposed away from the engagement portion and has an arc shape, wherein the rotation portion has a C shape, and wherein a part of the rotation portion that firstly contacts or approaches the wall at a time of attachment of the powder container is tapered.

11. The process cartridge according to claim 9, further comprising:

an inlet port;

a first cartridge shutter configured to open and close the inlet port;

an output port;

a second cartridge shutter configured to open and close the outlet port;

another wall;

another engagement portion opposed to said another wall, wherein the powder container includes:

a discharge port configured to communicate with the inlet port and discharge powder stored in the powder container;

a first container shutter configured to open and close the discharge port;

a collection port configured to communicate with the outlet port and to receive and collect powder flowing out through the outlet port;

a second container shutter configured to open and close the collection port;

another rotation portion configured to engage said another engagement portion and to rotate in conjunction with the operation of the operation device; and a shaft configured to couple the rotation portion and said another rotation portion, wherein said another rotation portion of the powder container is configured to contact said another wall of the process cartridge in a state in which said another rotation portion maintains a posture in the direction of attachment of the powder container to the process cartridge and is rotatable together with said another engagement portion of the process cartridge while engaging said another engagement portion, without hindering the powder container from moving in the direction of attachment, to restrain the powder container from moving in the direction of detachment of the powder container from the process cartridge.

12. The process cartridge according to claim 11, wherein said another rotation portion of the powder container engaging said another engagement portion is configured to rotate said another engagement portion in conjunction with the operation of the operation device and move the first cartridge shutter and the first container shutter to open and close the inlet port and the discharge port, and wherein the rotation portion of the powder container engaging the engagement portion is configured to rotate the engagement portion in conjunction with the operation of the operation device and move the second cartridge shutter and the second container shutter to open and close the outlet port and the collection port.

13. The process cartridge according to claim 9, wherein the process cartridge includes a biasing member configured to press the powder container in a state in which the rotation portion is rotatable together with the engagement portion while engaging the engagement portion, in a direction in which the rotation portion contacts the wall, and wherein the rotation portion of the powder container includes a fulcrum configured to contact a body of the process cartridge and rotate the rotation portion around the fulcrum while the biasing member presses the powder container in the direction of detachment when the rotation portion is rotated in a direction in which the rotation portion separates from the wall by the operation of the operation device.

14. An image forming apparatus, comprising:

a wall;

an engagement portion opposed to the wall; and a powder container configured to be detachably attached to the image forming apparatus, the powder container including an operation device; and a rotation portion configured to rotate in conjunction with operation of the operation device, wherein an outer circumferential surface of the rotation portion is configured to contact the wall in a state in which the rotation portion maintains a posture in a direction of attachment of the powder container to the image forming apparatus and is rotatable together with the engagement portion while engaging the engagement portion, without hindering the powder container from moving in the direction of attachment, to restrain the powder container from moving in a direction of detachment of the powder container from the image forming apparatus, and wherein the engagement portion engages the rotation portion on an opposite side of the rotation portion from the outer circumferential surface that contacts the wall.

15. The image forming apparatus according to claim 14, wherein the engagement portion has an arc-shaped projecting end, wherein the wall is disposed away from the engagement portion and has an arc shape, wherein the rotation portion has a C shape, and wherein a pail of the rotation portion that firstly contacts or approaches the wall at a time of attachment of the powder container is tapered.

16. The image forming apparatus according to claim 14, further comprising:

an inlet port;

a first cartridge shutter configured to open and close the inlet port;

an output port;

a second cartridge shutter configured to open and close the outlet port;

another wall;

another engagement portion opposed to said another wall, wherein the powder container includes:

a discharge port configured to communicate with the inlet port and discharge powder stored in the powder container;

a first container shutter configured to open and close the discharge port;

a collection port configured to communicate with the outlet port and to receive and collect powder flowing out through the outlet port;

a second container shutter configured to open and close the collection port;

another rotation portion configured to engage said another engagement portion and to rotate in conjunction with the operation of the operation device; and a shaft configured to couple the rotation portion and said another rotation portion, wherein said another rotation portion of the powder container is configured to contact said another wall of the image forming apparatus in a state in which said another rotation portion maintains a posture in the direction of attachment of the powder container to the image forming apparatus and is rotatable together with said another engagement portion of the image forming apparatus while engaging said another engagement portion, without hindering the powder container from moving in the direction of attachment, to restrain the powder container from moving in the direction of detachment of the powder container from the image forming apparatus.

17. The image forming apparatus according to claim 16, wherein said another rotation portion of the powder container engaging said another engagement portion is configured to rotate said another engagement portion in conjunction with the operation of the operation device and move the first cartridge shutter and the first container shutter to open and close the inlet port and the discharge port, and wherein the rotation portion of the powder container engaging the engagement portion is configured to rotate the engagement portion in conjunction with the operation of the operation device and move the second cartridge shutter and the second container shutter to open and close the outlet port and the collection port.

18. The image forming apparatus according to claim 14, wherein the image forming apparatus includes a biasing member configured to press the powder container in a state in which the rotation portion is rotatable together with the engagement portion while engaging the engagement portion, in a direction in which the rotation portion contacts the wall, and wherein the rotation portion of the powder container includes a fulcrum configured to contact a body of the image forming apparatus and rotate the rotation portion around the fulcrum while the biasing member presses the powder container in the direction of detachment when the rotation portion is rotated in a direction in which the rotation portion separates from the wall by the operation of the operation device.

19. The powder container of claim 1, wherein the rotation portion engages with both the wall and the engagement portion when the powder container is attached to the one of the image forming apparatus and the removable component.

* * * * *